US009414987B2

(12) United States Patent
Bagheri

(10) Patent No.: US 9,414,987 B2
(45) Date of Patent: Aug. 16, 2016

(54) WALKER

(71) Applicant: Kourosh Bagheri, Shell Beach, CA (US)

(72) Inventor: Kourosh Bagheri, Shell Beach, CA (US)

(73) Assignee: Entropy Enterprises, LLC, Shell Beach, CA (US)

( * ) Notice: Subject to any disclaimer, the term of this patent is extended or adjusted under 35 U.S.C. 154(b) by 0 days.

(21) Appl. No.: 15/013,000

(22) Filed: Feb. 2, 2016

(65) Prior Publication Data

US 2016/0151230 A1 Jun. 2, 2016

Related U.S. Application Data

(63) Continuation-in-part of application No. 14/617,872, filed on Feb. 9, 2015, now abandoned, which is a continuation of application No. 13/839,848, filed on Mar. 15, 2013, now Pat. No. 8,967,642.

(51) Int. Cl.
*A61H 3/04* (2006.01)

(52) U.S. Cl.
CPC ..... *A61H 3/04* (2013.01); *A61H 2003/043* (2013.01)

(58) Field of Classification Search
CPC ..... A61H 2003/043; A61H 3/04
See application file for complete search history.

(56) References Cited

U.S. PATENT DOCUMENTS 2,020,766 A * 11/1935 Brown ..... B62B 3/106 220/9.3
2,645,538 A * 7/1953 Segal ..... A47B 9/00 108/145
2,738,830 A * 3/1956 Black ..... A61H 3/00 135/67
3,778,052 A 12/1973 Andow
3,840,034 A * 10/1974 Smith ..... A61H 3/00 135/67
4,019,756 A * 4/1977 Ishida ..... A47D 1/004 280/649
4,123,078 A * 10/1978 Murakami ..... A47D 13/043 280/87.041
4,249,749 A * 2/1981 Collier ..... B62B 1/00 108/145
4,272,071 A 6/1981 Bolton (Continued)

OTHER PUBLICATIONS

Bagheri: U.S. Appl. No. 14/617,872, filed Feb. 9, 2015.

(Continued)

*Primary Examiner* — Jeffrey J Restifo
*Assistant Examiner* — Erez Gurari
(74) *Attorney, Agent, or Firm* — Fitch, Even, Tabin & Flannery LLP

(57) ABSTRACT

An apparatus having an upper frame adapted to at least partially encircle a person and including a lower frame and two double scissor mechanisms for coupling the upper frame to the lower frame, wherein the distance between the upper frame and the lower frame can be varied by adjusting the double scissor mechanisms, and the walker is raised or lowered. Scissor lift assemblies housed in the lower frame, each powered by a motor or compressor, raise and lower each double scissor mechanism.

23 Claims, 28 Drawing Sheets

(56) References Cited

U.S. PATENT DOCUMENTS 4,342,465 A * 8/1982 Stillings ..... A61H 3/04 135/67
4,621,804 A * 11/1986 Mueller ..... A47D 13/043 135/67
4,770,410 A * 9/1988 Brown ..... A61H 3/04 135/67
4,799,700 A * 1/1989 Knoedler ..... A47D 13/043 108/120
4,822,030 A * 4/1989 Cone ..... A47D 13/043 280/43.24
4,941,497 A 7/1990 Prather
5,033,758 A * 7/1991 Levy ..... B62B 3/02 211/201
5,040,556 A 8/1991 Raines
5,083,806 A 1/1992 Brown
5,112,044 A 5/1992 Dubats
5,123,665 A * 6/1992 Levy ..... B62B 3/022 211/201
5,217,033 A * 6/1993 Herman, Jr. ..... A61H 3/02 135/68
5,228,708 A 7/1993 Verdugo
5,244,443 A * 9/1993 Cerda ..... A47D 15/00 280/87.051
5,255,697 A 10/1993 Grauer
5,324,064 A 6/1994 Sumser
5,366,231 A * 11/1994 Hung ..... A47C 7/006 16/44
5,476,432 A 12/1995 Dickens
5,538,268 A * 7/1996 Miller ..... A61H 3/04 280/87.041
5,564,136 A 10/1996 Cox
5,601,302 A 2/1997 Beard
5,727,800 A * 3/1998 Liu ..... A47D 13/043 188/5
5,732,961 A * 3/1998 Theodoropoulos .. A47D 13/043 280/87.051
5,813,720 A * 9/1998 Huang ..... A47D 13/043 280/87.051
5,813,948 A 9/1998 Quigg
6,120,045 A * 9/2000 Rosko ..... A47D 13/043 280/87.021
6,170,840 B1 * 1/2001 Mathias ..... A63B 69/0064 135/69
6,231,056 B1 * 5/2001 Wu ..... A47D 1/02 280/1.188
6,494,815 B1 * 12/2002 Welsh, Jr. ..... A47D 13/043 280/87.051
6,527,285 B1 3/2003 Calandroll
6,675,820 B2 * 1/2004 Balan ..... A61H 3/008 135/67
6,733,018 B2 5/2004 Razon
6,742,523 B2 6/2004 Dubats
6,948,727 B1 * 9/2005 Bakken ..... A61H 3/04 135/67
7,055,847 B2 * 6/2006 Miller ..... B62B 3/022 248/161
7,156,465 B2 * 1/2007 Stewart, III ..... A47C 7/021 297/230.1
7,237,844 B2 * 7/2007 Stewart, III ..... A47C 7/021 297/230.1
8,162,333 B1 * 4/2012 Bartlett ..... A47D 1/004 280/643
8,215,652 B2 * 7/2012 Dashew ..... A61H 3/04 135/67
8,251,380 B2 * 8/2012 Liu ..... A61H 3/04 135/67
8,333,208 B2 * 12/2012 Miller ..... A61H 3/04 135/67
8,562,007 B2 * 10/2013 Menichini ..... A61H 3/04 135/67
8,646,804 B2 * 2/2014 Derks ..... A61G 5/08 135/67
8,967,642 B2 * 3/2015 Bagheri ..... A61G 5/1002 135/67
2005/0082886 A1 4/2005 Sganga
2005/0183759 A1 8/2005 Wolfe
2007/0163633 A1 * 7/2007 Gale ..... A61H 3/04 135/67
2010/0170546 A1 * 7/2010 Popovic ..... A61H 3/008 135/67
2011/0067740 A1 * 3/2011 Menichini ..... A61H 3/04 135/67
2011/0241303 A1 * 10/2011 Campbell ..... A45B 9/02 280/87.041
2011/0260421 A1 * 10/2011 Willis ..... A61H 3/04 280/87.041
2012/0215408 A1 * 8/2012 James ..... B60P 1/02 701/48
2012/0274037 A1 * 11/2012 Miller ..... A61H 3/04 280/87.041
2012/0318587 A1 * 12/2012 Alghazi ..... A61G 7/10 180/6.5
2015/0150748 A1 6/2015 Bagheri

OTHER PUBLICATIONS

Bagheri; U.S. Appl. No. 13/839,848, filed Mar. 15, 2013.
Non-final office action from U.S. Appl. No. 13/839,848 mailed May 9, 2014.
Notice of Allowance from U.S. Appl. No. 13/839,848 mailed Oct. 23, 2014.
Restriction Requirement from U.S. Appl. No. 13/839,848 mailed Feb. 20, 2014.
Restriction Requirement from U.S. Appl. No. 14/617,872 mailed Aug. 4, 2015.

* cited by examiner

WALKER

CROSS-REFERENCE TO RELATED APPLICATIONS

This application is a continuation-in-part of U.S. application Ser. No. 14/617,872 filed Feb. 9, 2015, entitled WALKER, which is a continuation of U.S. application Ser. No. 13/839,848 filed Mar. 15, 2013, entitled WALKER, now U.S. Pat. No. 8,967,642, both of which are incorporated in their entirety herein by reference.

BACKGROUND OF THE INVENTION

1. Field of the Invention

The present invention relates generally to an adult walker for assisting the disabled or those who have difficulty ambulating and, more specifically, with an adult walker for seated or standing use. Even more specifically, this invention relates to an adult walker with provisions for incontinent persons.

2. Discussion of the Related Art

Adult walkers and wheelchairs are known in the art which assist the mobility of persons, such as the elderly or disabled, who are unable to walk or move around without assistance. These devices have improved the range of activity of such persons under conditions where available assistance by personnel is limited. A person requiring mobility assistance may also be incontinent, dictating a device which both provides mobility and security while accommodating incontinence needs and providing for the comfort of the user.

Wheelchairs are one method of providing mobility, and the prior art includes wheelchair commodes for use by incontinent persons. However, since the wheelchair provides no exercise or movement for legs, these muscles will atrophy more quickly and ultimately diminish the physical strength of the patient.

Various types of adult walkers are commonly used by elderly or disabled persons who have the capability of supporting their weight on their legs and walking, but cannot do so unassisted because of a tendency to stumble or fall. For example, elderly persons who reside in long-term care facilities frequently have a great need to exercise and to convey themselves from one location to another, but are afraid to do so without the assistance of an aid.

A wide variety of adult walkers have been devised for elderly or disabled persons. Adult walkers typically consist of a rigid frame supported on the floor. Numerous frame variations are found in the art. For the more ambulatory, the adult walker legs rest directly on the floor. The person lifts the frame, extends it forward with his arms, and walks for one or more steps before lowering the frame to the floor. Other frame variations incorporate a combination of wheels and legs so that the adult walker may be tilted and rolled forward. For the less ambulatory, the adult walker may be supported solely by three or more wheels, and the person need only apply a lateral force to move the walker. Tipping can be a hazard, especially since the elderly or disabled may have limited balance. Depending on the number and location of wheels and/or legs, the adult walker may fail to provide sufficient lateral support against tipping, especially if the person is overweight.

Most adult walkers are vertically adjustable so that users of different sizes and/or needs can be accommodated. Commonly the adjustment is provided by a type of telescoping leg.

Adult walkers may have an enclosed design with a moveable portion that allows the person to enter or exit when open while providing additional support and security in the closed position. Alternately, the adult walker may have an open front or back that allows for support while providing ease of entry and exit.

Some adult walkers have a seat or sling. This allows the walker to fully support the person in a seated position and may also be used to prevent falls. The support may be integral or removable. Some adult walkers have a strap or multiple straps to assist in securing the person and preventing falls.

Another feature of some adult walkers is a foldable design or a design that allows for easy disassembling. This allows the walker to be more easily transported or stored.

Persons using adult walkers may have need of additional medical equipment while using the walker. Some walkers are equipped with support or attachment devices for medical equipment such as IV bags or medication dispensers. However, walker designs to accommodate incontinence are not found in the prior art, even though persons requiring walker use may be incontinent as well.

SUMMARY OF THE INVENTION

Several embodiments of the invention advantageously address the needs above as well as other needs by providing a walker apparatus comprising a U-shaped lower frame comprising a left lower arm and a right lower arm connected by a front lower connector, the lower frame oriented in a horizontal position; a plurality of casters coupled to an underside of the lower frame and supporting the lower frame on a floor and allowing the walker to roll across the floor; a U-shaped upper frame comprising a left upper arm and a right upper arm connected by a front upper connector, the upper frame oriented in a horizontal position generally above the lower frame, whereby the left upper arm is generally above the left lower arm and the right upper arm is generally above the right lower arm, and wherein the lower frame and upper frame are configured to surround a person on three sides; a generally vertical left double scissor mechanism interposed between the left lower arm and the left upper arm; and a generally vertical right double scissor mechanism interposed between the right lower arm and the right upper arm, each double scissor mechanism comprising a top X-shaped scissor pivotally coupled to a bottom X-shaped scissor, wherein a vertical distance between the upper frame and the lower frame can be varied by simultaneously adjusting the left double scissor mechanism and the right double scissor mechanism.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
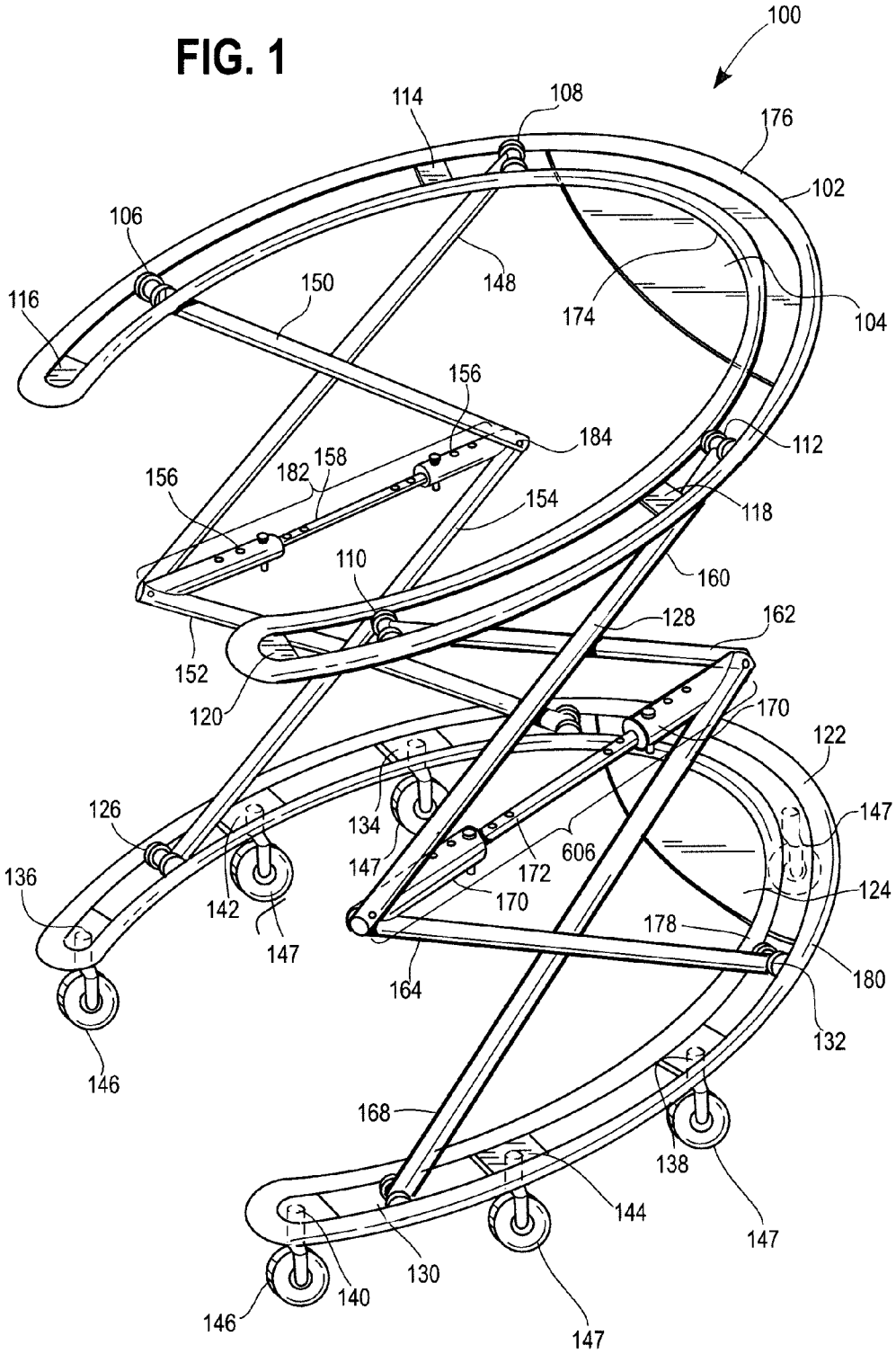
FIG. 1 is a perspective view of an adult walker frame.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Referring first to FIG. 1, an adult walker 100 in one embodiment of the invention is shown. The top portion of the adult walker 100 includes a top horseshoe 102, top front plate 104, a left top rear pivot attachment 106, a left top front pivot attachment 108, a right top rear pivot attachment 110, a right top front pivot attachment 112, a left top front plate 114, a left top rear plate 116, a right top front plate 118, and a right top rear plate 120. The bottom portion of the adult walker 100 includes a bottom horseshoe 122, a bottom front plate 124, a left bottom rear pivot attachment 126, a left bottom front pivot attachment 128, a right bottom rear pivot attachment 130 and a right bottom front pivot attachment 132, a left bottom front plate 134, a left bottom rear plate 136, a right bottom front plate 138, a right bottom rear plate 140, a left bottom middle plate 142, a right bottom middle plate 144, a plurality of locking wheels 146, and a plurality of non-locking wheels 147. Joining the top and bottom horseshoes 102, 122 on the left side are a top left outer rod 148, a top left inner rod 150, a bottom left outer rod 152, a bottom left inner rod 154, a plurality of left outer tubes 156, and a left inner tube 158. Joining the top and bottom horseshoes 102, 122 on the right side are a top right outer rod 160, a top right inner rod 162, a bottom right outer rod 164, a bottom right inner rod 168, a plurality of right outer tubes 170, and a right inner tube 172.

The top horseshoe 102 in one embodiment of the invention is made of ¼ inch solid aluminum rods which form a top inner horseshoe rail 174 and top outer horseshoe rail 176. Each horseshoe rail 174, 176 is formed in a horseshoe shape, with the top horseshoe rails 174, 176 running parallel with an approximately 2 inches clear distance between the rails. The top horseshoe rails 174, 176 are joined at the horseshoe shape ends so that the top horseshoe rails 174, 176 are continuous. The top horseshoe rails 174, 176 at the horseshoe shape ends form an arc. The front of the adult walker 100 is designated as the location of the midpoint of the horseshoe shape, and the rear of the adult walker 100 is designated as the location of the horseshoe ends. The length of the top horseshoe 102 in this embodiment is approximately 36" measured along the line of symmetry of the top horseshoe 102. The top front plate 104 in a pointed oval shape is coupled to the underside of the front portion of the top horseshoe 102. The top front plate 104 is made of aluminum or other suitable material. The top front plate 104 is oriented so that the front curved edge of the top front plate 104 aligns with the front edge of the top horseshoe 102. The left top front plate 114 approximately 2.5 inches× 2.5 inches is coupled to the underside of the top horseshoe 102 at approximately a one-third point along the left side of the top horseshoe 102, starting at the front of the top horseshoe 102. The right top front plate 118 approximately 2.5 inches×2.5 inches is coupled to the underside of the top horseshoe 102 at approximately a one-third point along the right side of the top horseshoe 102, starting at the front of the top horseshoe 102. The left and right top front plates 114, 118 are made of aluminum or other suitable material. The left top rear plate 116 approximately 2.5 inches×2.5 inches is coupled to the underside of the top horseshoe 102 so that one side of the plate aligns with the left end of the top horseshoe 102. The right top rear plate 120 approximately 2.5 inches×2.5 inches is coupled to the underside of the top horseshoe 102 so that one side of the plate aligns with the right edge of the top horseshoe 102. The left and right top rear plates 116, 120 are made of aluminum or other suitable material. The left top rear pivot attachment 106 is shown on the left side of the top horseshoe 102 near the top horseshoe's left end. The left top front pivot attachment 108 is shown on the left side of the top horseshoe 102 near the left edge of the top front plate 104. The left top pivot attachments 106, 108 span horizontally between the parallel top horseshoe rails 174, 176. The right top rear pivot attachment 110 is shown on the right side of the top horseshoe 102 near the horseshoe's right end. A right top front pivot attachment 112 is shown on the right side of the top horseshoe 102 near the right edge of the top front plate 104. The right top pivot attachments 110, 112 span horizontally between the parallel top horseshoe rails 174, 176. The pivot attachments 106, 108, 110, 112 are described in more detail below.

The bottom horseshoe 122 in one embodiment of the invention is made of ¼ inch solid aluminum rods which form the bottom inner horseshoe rail 178 and bottom outer horseshoe rail 180. Each horseshoe rail 178, 180 is formed in a horseshoe shape, with the bottom horseshoe rails 178, 180 running parallel with an approximately 2 inch clear distance between the rails. The bottom horseshoe rails 178, 180 are joined at the horseshoe shape ends so that the bottom horseshoe rails 178, 180 are continuous. The bottom horseshoe rails 178, 180 at the horseshoe shape ends form an arc. The length of the bottom horseshoe 122 in this embodiment is approximately 36 inches measured along the line of symmetry of the bottom horseshoe 122. The bottom front plate 124 in a pointed oval shape is coupled to the underside of the front portion of the bottom horseshoe 122. The bottom front plate 124 is made of aluminum or other suitable material. The bottom front plate 124 is oriented so that the front curved edge of the bottom front plate 124 aligns with the front edge of the bottom horseshoe 122. The left bottom rear pivot attachment 126 is shown on the left side of the bottom horseshoe 122 near the horseshoe's left end. The left bottom front pivot attachment 128 is shown on the left side of the bottom horseshoe 122 near the left edge of the bottom front plate 124. The left bottom pivot attachments 126, 128 span horizontally between the bottom horseshoe rails 178, 180. The right bottom rear pivot attachment 130 is shown on the right side of the bottom horseshoe 122 near the horseshoe's right end. The right bottom front pivot attachment 132 is shown on the right side of the bottom horseshoe 122 near the right edge of the bottom front plate 124. The right bottom pivot attachments 130, 132 span horizontally between the bottom horseshoe rails 178, 180. The six bottom plates 134, 136, 138, 140, 142, 144 are shown coupled to the underside of the bottom horseshoe 122. The bottom plates 134, 136, 138, 140, 142, 144 are made of aluminum or other suitable material and are sized to provide secure attachment to the underside of the bottom horseshoe rails 178, 180 and also to provide sufficient area for wheel attachment. The left and right bottom rear plates 136, 140 are located at the left and right ends of the bottom horseshoe 122, respectively. The left and right bottom middle plates 142, 144 are located approximately halfway between the front and rear of the walker frame. The left and right bottom front plates 134, 136 are approximately equidistant from the middle wheel, with sufficient clearance given for the adjacent front pivot attachment.

The top horseshoe 102 and the bottom horseshoe 122 are connected vertically on each side by a series of adjustment rods 148, 150, 152, 154, 160, 162, 164, 168. These rods 148, 150, 152, 154, 160, 162, 164, 168 provide vertical support of the top horseshoe 102 and vertical adjustment of the height of the top horseshoe 102. On each side of the walker 100, the adjustment rods 148, 150, 152, 154, 160, 162, 164, 168 form a vertical double-X shape, with one X on top of the other X. The double-X, also referred to as a scissor mechanism, extends on the left side from the left side of the top horseshoe 102 to the left side of the bottom horseshoe 122. The left top X is formed by the left top outer rod 148 and the left top inner rod 150. The top end of the left top outer rod 148 is coupled to the left top front pivot attachment 108 so that the left top outer rod 148 may pivot or rotate in a vertical plane. The left top outer rod 148 extends diagonally downward and to the rear. The top end of the left top inner rod 150 is coupled to the left top rear pivot attachment 106 so that the left top inner rod 150 may pivot or rotate in a vertical plane. The left top inner rod 150 extends diagonally downward and to the front. The left bottom X is formed by the left bottom outer rod 152 and the left bottom inner rod 154. The bottom end of the left top outer rod 148 is coupled to the top end of the left bottom outer rod 152 so that the outer rods 148, 152 may rotate in the same plane. The bottom end of the left bottom outer rod 152 is coupled to the left bottom front pivot attachment 128 so that the left bottom outer rod 152 may rotate or pivot in a vertical plane. The bottom end of the left top inner rod 150 is coupled to the top end of the left bottom inner rod 154 so that the left bottom inner rods 150, 154 may rotate in the same plane. The bottom end of the left bottom inner rod 154 is coupled to the left bottom rear pivot attachment 126 so that the left bottom inner rod 154 may rotate or pivot in a vertical plane. Where the top X connects to the bottom X, a left horizontal telescoping adjustment tube 182 joins the front side of the X to the rear side of the X. The left telescoping adjustment tube 182 is comprised of the two left outer tubes 156 and the left inner tube 158. One left outer tube 156 is located at each end of the left inner tube 158 so that the outer tubes 156 may slide over the ends of the inner tube 158, lengthening or shortening the left telescoping adjustment tube 182. The left telescoping adjustment tube 182 is connected to a plurality of rod pivot points 184 so that the inner and outer rods 148, 150, 152, 154 may rotate or pivot relative to the left telescoping adjustment tube 182. The rotation of the inner and outer rods 148, 150, 152, 154 raises and lowers the top horseshoe 102. The left telescoping adjustment tube 182 provides additional stability to the vertical adjustment and locks the top horseshoe 102 height in place. The operation of the vertical adjustment is described in more detail below. The vertical adjustment system as previously described is repeated on the right hand side of the adult walker 100.

Figure 2:
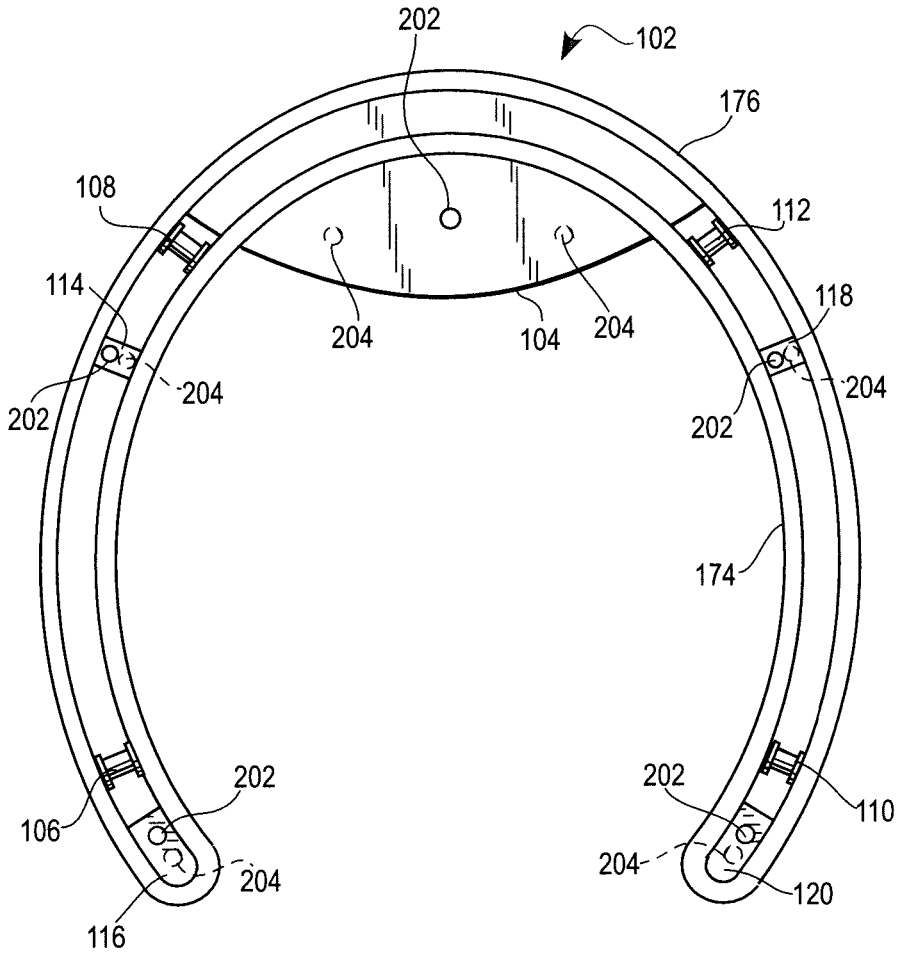
FIG. 2 is a plan view of a top horseshoe frame.

Referring next to FIG. 2, a plan view of the top horseshoe 102 of the adult walker 100 is shown. Shown are the top horseshoe 102, the top front plate 104, the left top front pivot attachment 108, the left top rear pivot attachment 106, the right top front pivot attachment 112, the right top rear pivot attachment 110, the left top front plate 114, the left top rear plate 116, the right top front plate 118, the right top rear plate 120, the top inner horseshoe rail 174, the top outer horseshoe rail 176, a plurality of top cover bolt shafts 202, and a plurality of eye hooks 204. Each eye hook is coupled to and extends vertically downward from one of the top plates 104, 106, 108, 118, 120. The left and right top plates 106, 108, 118, 120 have one eye hook each, with the eye hook approximately centered on the plate. The top front plate 104 has two eye hooks 204 that are approximately evenly spaced along the rear crescent of the top front plate 104 shape. The eye hooks 204 are used to attach a seat 206, a support belt 208 or other attachments. The top plates 104, 106, 108, 118, 120 also have one top cover bolt shaft 202 each. The top cover bolt shafts 202 are coupled to the top of the top plates 104, 106, 108, 118, 120 and extend upward vertically. The top cover bolt shafts 202 are located approximately centered on the left and right top plates 106, 108, 118, 120, but are not required to align with the location of the eye hooks 204. The top cover bolt shaft 202 coupled to the top front plate 104 is located along the line of symmetry of the horseshoe, approximately equidistant from the edge of the top horseshoe 102 and the edge of the top front plate 104. The top cover bolt shafts 202 are used to attach a frame cover, which is detailed below.

Figure 3:
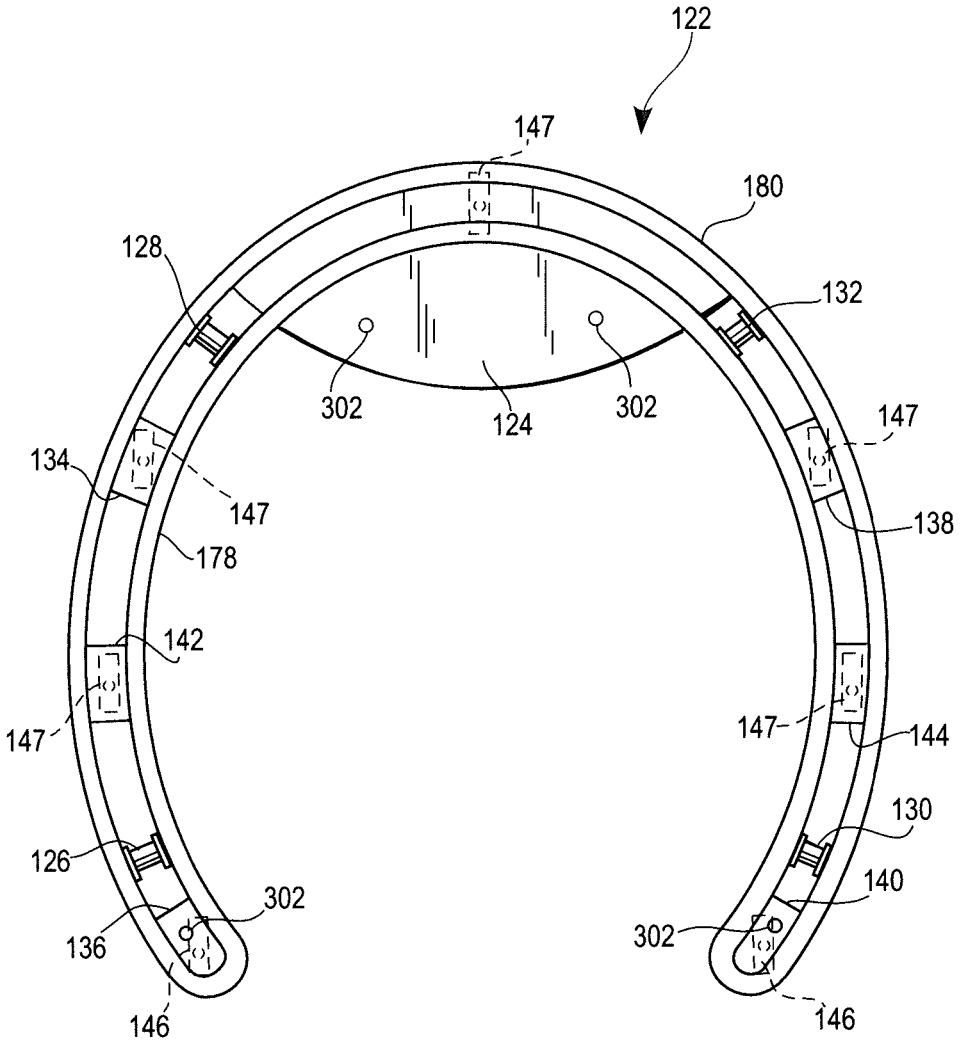
FIG. 3 is a plan view of a bottom horseshoe frame.

Referring next to FIG. 3, a plan view of the bottom horseshoe 122 of the adult walker 100 is shown. Shown are the bottom horseshoe 122, the bottom front plate 124, the left bottom front pivot attachment 128, the left bottom rear pivot attachment 126, the right bottom front pivot attachment 132, the right bottom rear pivot attachment 130, the left bottom front plate 134, the left bottom rear plate 136, the right bottom front plate 138, the right bottom rear plate 140, the left bottom middle plate 142, the right bottom middle plate 144, the plurality of locking wheels 146, the plurality of non-locking wheels 147, and a plurality of bottom cover bolt shafts 302. In this embodiment, two locking wheels 146 are shown. One locking wheel 146 is coupled to the underside of the left bottom rear plate 136, and the second locking wheel 146 is coupled to the underside of the right bottom rear plate 140. In this embodiment, five non-locking wheels 147 are shown. The wheels are coupled to the underside of the following plates 124, 134, 138, 142, 144, one wheel per plate: the bottom front plate 124, the left bottom front plate 134, the right bottom front plate 138, the left bottom middle plate 142 and the right bottom middle plate 144. The wheels are located approximately in the center of the plates 134, 138, 142, 144, with the exception of the non-locking wheel 147 coupled to the bottom front plate 124, which is located at the front of the walker frame, on the line of symmetry, and between bottom horseshoe rails 178, 180 forming the bottom horseshoe 122. The approximate wheel diameter for both locking and non-locking wheels 146, 147 is 3 inches. The bottom rear plates 136, 140 have one bottom cover bolt shaft each. The bottom cover bolt shafts 302 are coupled to the top of the bottom rear plates 136, 140 and extend upward vertically. The bottom cover bolt shafts 302 are located approximately centered on each bottom rear plate 136, 140, but are not required to align with the location of locking wheels 146. In this embodiment, two additional bottom cover bolt shafts 302 are coupled to the top of the bottom front plate 124 and are approximately evenly spaced along the rear crescent of the bottom front plate 124 shape. The bottom cover bolt shafts 302 are used to attach a plurality of bottom horseshoe covers 802, 804, 806 which are detailed below.

Figure 4:
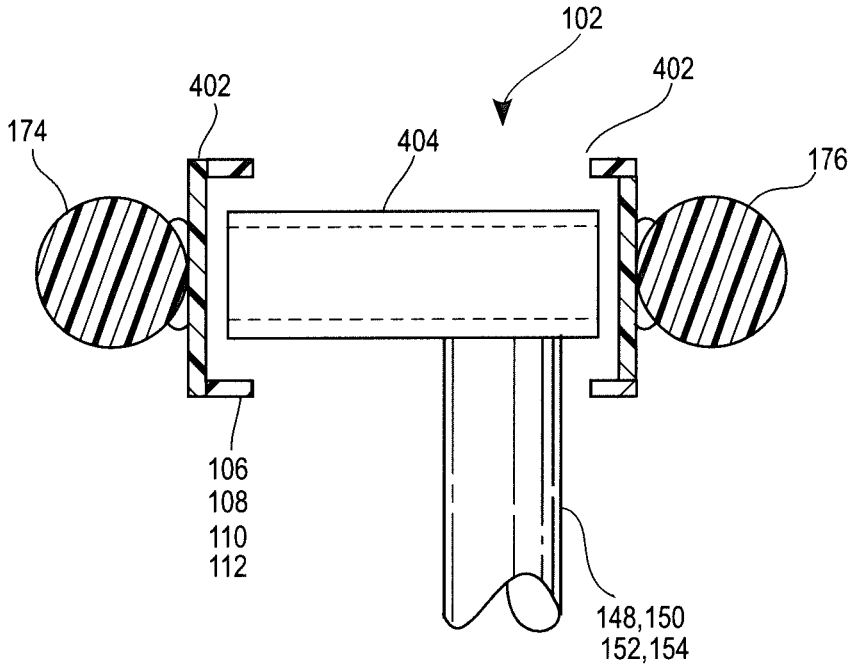
FIG. 4 is a detail of a top pivot attachment.

Referring next to FIG. 4, a detail of the top pivot attachment is shown. This detail applies to the left top front pivot attachment 108, the left top rear pivot attachment 106, the right top front pivot attachment 112, and the right top rear pivot attachment 110. Shown are the top horseshoe 102, a plurality of large pivot adjustment sleeves 402, and a small pivot adjustment rod 404. Also shown are the top inner horseshoe rail 174 and the top outer horseshoe rail 176. The top horseshoe 102 is shown in cross-section, i.e., the two rails 174, 176 comprising the horseshoe are shown in cross section and have the same horizontal centerline and a gap between them. The small pivot adjustment rod 404 is located horizontally between the top horseshoe rails 174, 176 but stops short of the inner edges of the horseshoe rails 174, 176. The centerline of the small pivot adjustment rod 404 is perpendicular to the centerlines of the top horseshoe rails 174, 176. Each end of the small pivot adjustment rod 404 fits inside the large pivot adjustment sleeve 402, which in turn is coupled to the adjacent top horseshoe rail 174, 176. Each large pivot adjustment sleeve 402 consists of an approximately ½" diameter circular plate coupled to the end of a short piece of approximately ½" diameter tube. Each sleeve is coupled to the inside face of a top horseshoe rail 174, 176 with the tube portion perpendicular to the centerlines of the top horseshoe rails 174, 176 and open to the inside. Each end of the small pivot attachment rod 404 is coupled to a large pivot adjustment sleeve 402 so that the small pivot attachment rod 404 is supported by the large pivot attachment sleeves 402 while still being able to rotate freely about its axis. One end of the outer rod 148, 160 or inner rod 150, 162 is coupled to the small pivot attachment rod 404.

Figure 5:
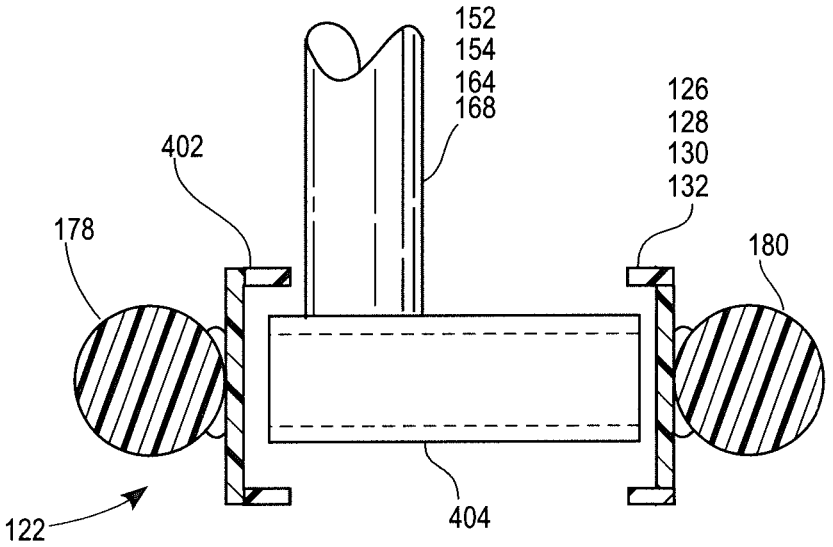
FIG. 5 is a detail of a bottom pivot attachment.

Referring next to FIG. 5, a detail of the bottom pivot attachment is shown. This detail applies to the left bottom front pivot attachment 128, the left bottom rear pivot attachment 126, the right bottom front pivot attachment 130, the right bottom rear pivot attachment 132. Shown are the bottom horseshoe 122, the plurality of large pivot adjustment sleeves 402, and the small pivot adjustment rod 404. Also shown is either the left bottom inner rod 154, the left bottom outer rod 152, the right bottom inner rod 168 or the right bottom outer rod 164. The structure and operation of the bottom pivot attachments 126, 128, 130, 132 is similar to that of the top pivot attachments 106, 108, 110, 112.

Figure 6:
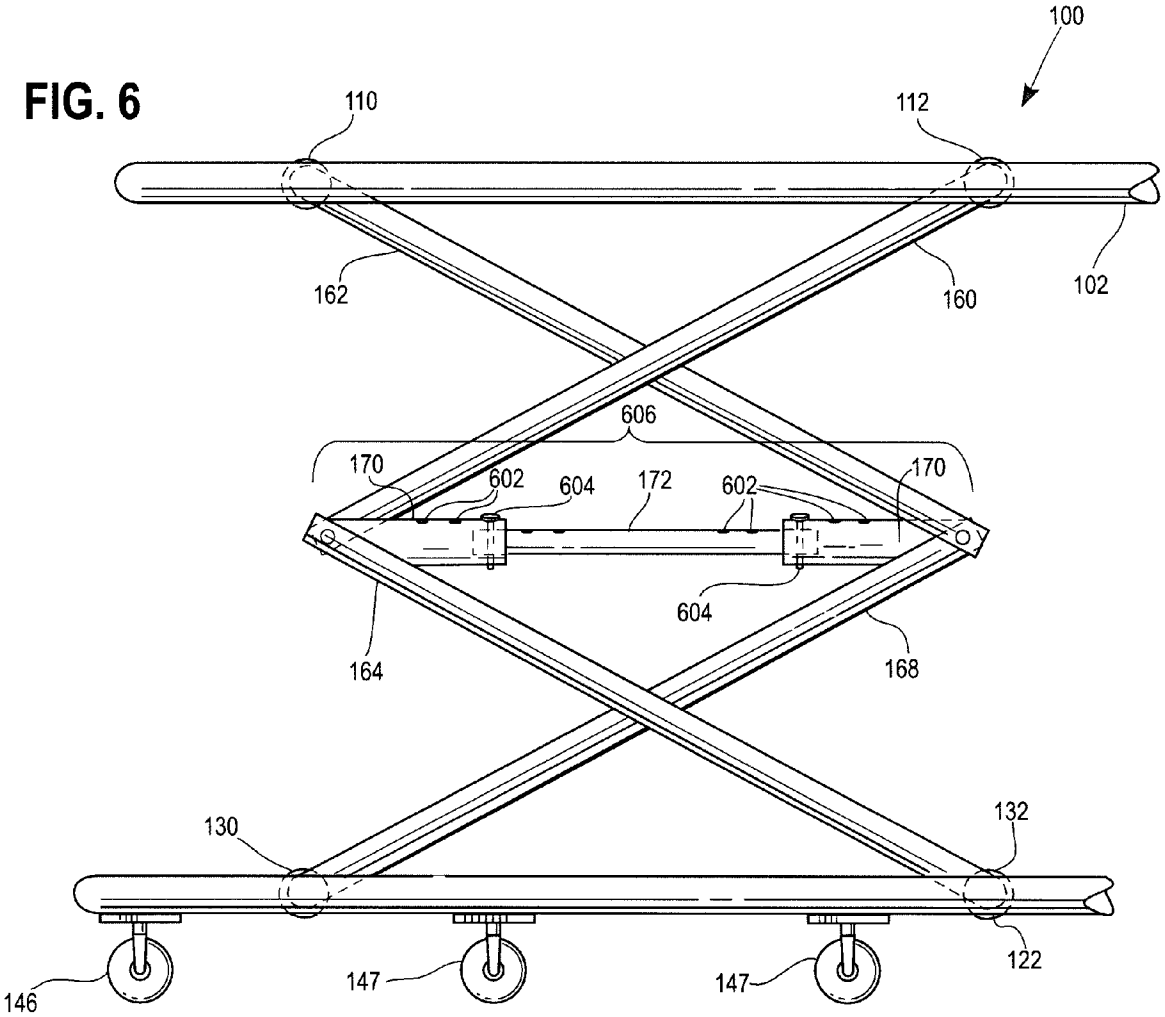
FIG. 6 is a side view of the adult walker frame.

Referring next to FIG. 6, an elevation of the right side of the adult walker 100 is shown. Shown are the top horseshoe 102, the bottom horseshoe 122, the top right outer rod 160, the top right inner rod 162, the bottom right outer rod 164, the bottom right inner rod 168, the right top rear pivot attachment 110, the right top front pivot attachment 112, the right bottom rear pivot attachment 130, the right bottom front pivot attachment 132, the plurality of non-locking wheels 147, the locking wheel 146, the plurality of right outer tubes 170, the right inner tube 172, a plurality of vertical adjustment holes 602 and a plurality of lock pins 604. As described above, rods 160, 162, 164, 168 form a double-X which raises and lowers the top horseshoe 102 as the rods 160, 162, 164, 168 rotate about the pivot attachments 110, 112, 130, 132. The right inner and outer tubes 170, 172 form a right telescoping adjustment tube 606 (as previously shown in FIG. 1), located horizontally between the Xs. The plurality of vertical adjustment holes 602 are located at each right outer tube 170 end nearest the right inner tube 172 and each right inner tube 172 end nearest the right outer tube 170. The vertical adjustment holes 602 extend through both the top and bottom of the tubes 170, 172. At each end of the right inner tube 170 is the lock pin 604. At each side of the right inner tube 170, one vertical adjustment hole 602 in the right inner tube 170 is aligned with one vertical adjustment hole 602 in the adjacent right outer tube 172. The lock pin 604 is inserted through the holes 602 in both right tubes 170, 172, locking the length of the right telescoping adjustment tube 606 in place. As the adjustment holes 602 are used to lengthen the telescoping adjustment tube 606, the rods 160, 162, 164, 168 rotate and the double-X is reduced in height, lowering the top horseshoe 102. As the adjustment holes 602 are used to shorten the telescoping adjustment tube 156, 158, the rods 160, 162, 164, 168 rotate in the opposite direction and the double-X increases in height, raising the top horseshoe 102. The vertical adjustment may be used to adjust the height of the walker 100 for the user, or to fold the walker frame for transportation or storage. The left telescoping tube 182 on the left side of the walker operates similarly.

Figure 7:
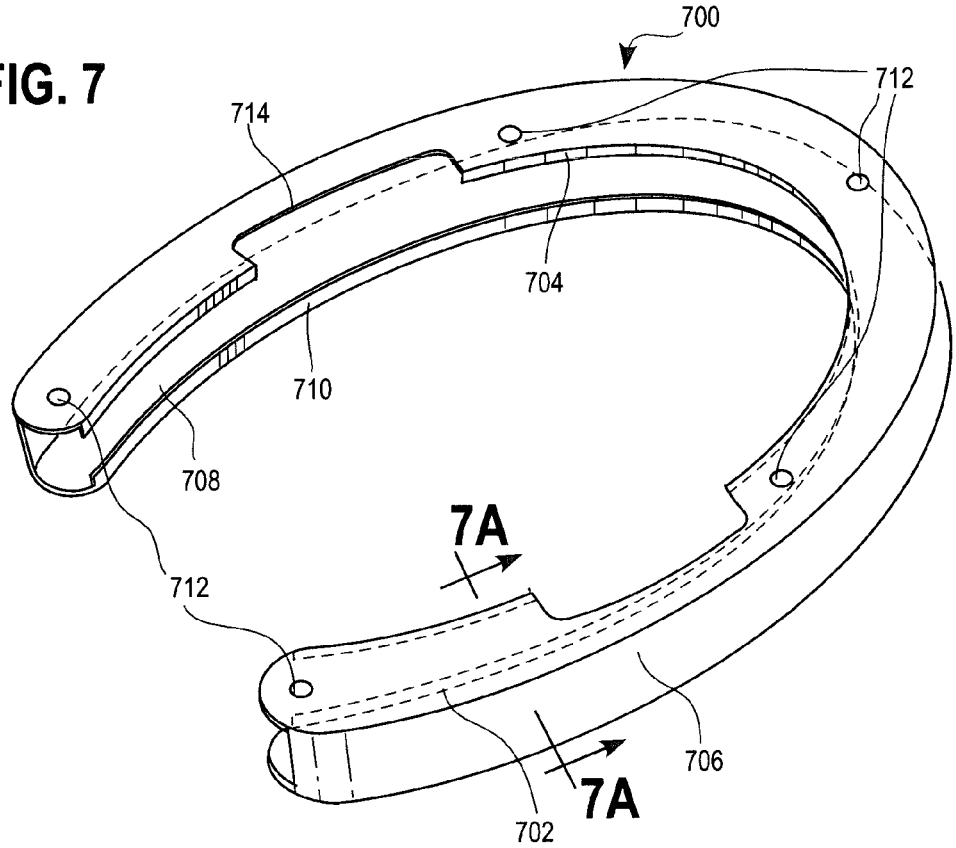
FIG. 7 is a perspective view of a top cover for the adult walker frame.
Figure 7A:
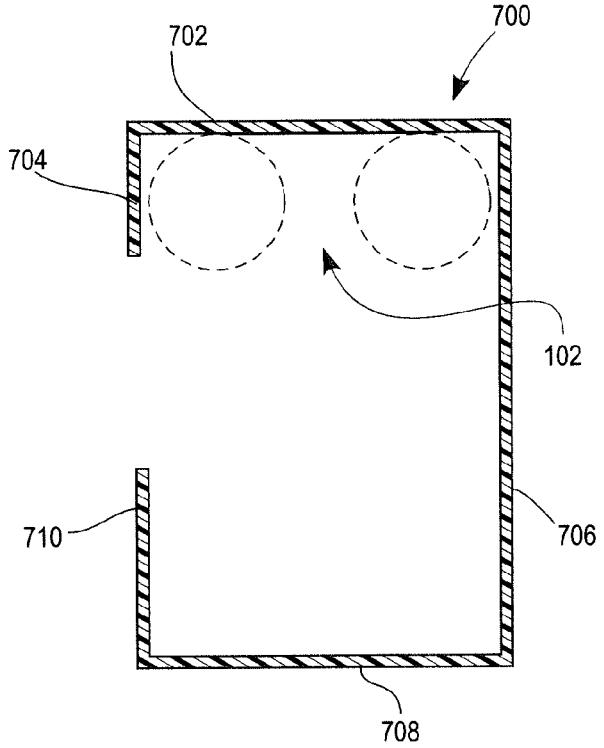
FIG. 7A is a cross-section view of the top cover for the adult walker frame.

Referring next to FIG. 7, a top horseshoe cover 700 is shown. The top horseshoe cover 700 includes a top cover top 702, a top cover top return 704, a top cover side 706, a top cover bottom 708, a top cover bottom return 710, a plurality of top cover bolt holes 712 and a plurality of grip indentations 714. The top cover top 702 is shaped to cover the top horseshoe 102 and provide a horizontal flat surface. The top cover top 702 overhangs the top horseshoe 102 in a sufficient dimension to be able to remove and replace the top horseshoe cover 700, while providing a secure fit to the top horseshoe 102. The width of the top cover top 702 is approximately 2.5 inches. The top cover side 706 is coupled to and extends down vertically from the outside edge of the top cover top 702. The width of the top cover side 706 is approximately 6 inches. The top cover top return 704 is coupled to and extends down vertically from the inside edge of the top cover top 702. The width of the top cover top return 704 is approximately 3 inches The top cover bottom 708 is coupled to and extends horizontally from the top cover side 706 bottom edge, towards the inside of the top horseshoe 102. The width of the top cover bottom 708 is approximately 2.5 inches. The top cover bottom return 710 is coupled to the inside edge of the top cover bottom 708 and extends vertically upward approximately 3". The top horseshoe cover 700 essentially forms a continuous reverse channel shape that covers the top horseshoe 102, providing a smooth, continuous cover to the top horseshoe 102 on three sides. A section through the top horseshoe cover 700 is shown in FIG. 7A. The plurality of top cover bolt holes 712 are provided in locations to align with the top cover bolt shafts 202 when the top horseshoe cover 700 is in place. In one embodiment, the top cover bolt shafts 202 are threaded and a nut is used to secure the top horseshoe cover 700 to the top horseshoe 102. Along the sides of the top horseshoe cover 700, about halfway between the front and rear of the top horseshoe cover 700, a portion of the top horseshoe cover 700 is removed. For a length of approximately 12" on each horseshoe 102 side, the top cover top return 704 and approximately the inside half of the top cover top 702 are removed. This exposes the top horseshoe inner rail 174 for approximately a 12 inch length, allowing for the top horseshoe inner rail 174 to be gripped by the user for stability. In the preferred embodiment of the invention, the top horseshoe inner rail 174 exposures are located approximately halfway down the side of the top horseshoe 102 and are symmetrical about the top horseshoe 102 line of symmetry. In the preferred embodiment, the top horseshoe cover 700 is made of polyurethane.

Figure 8:
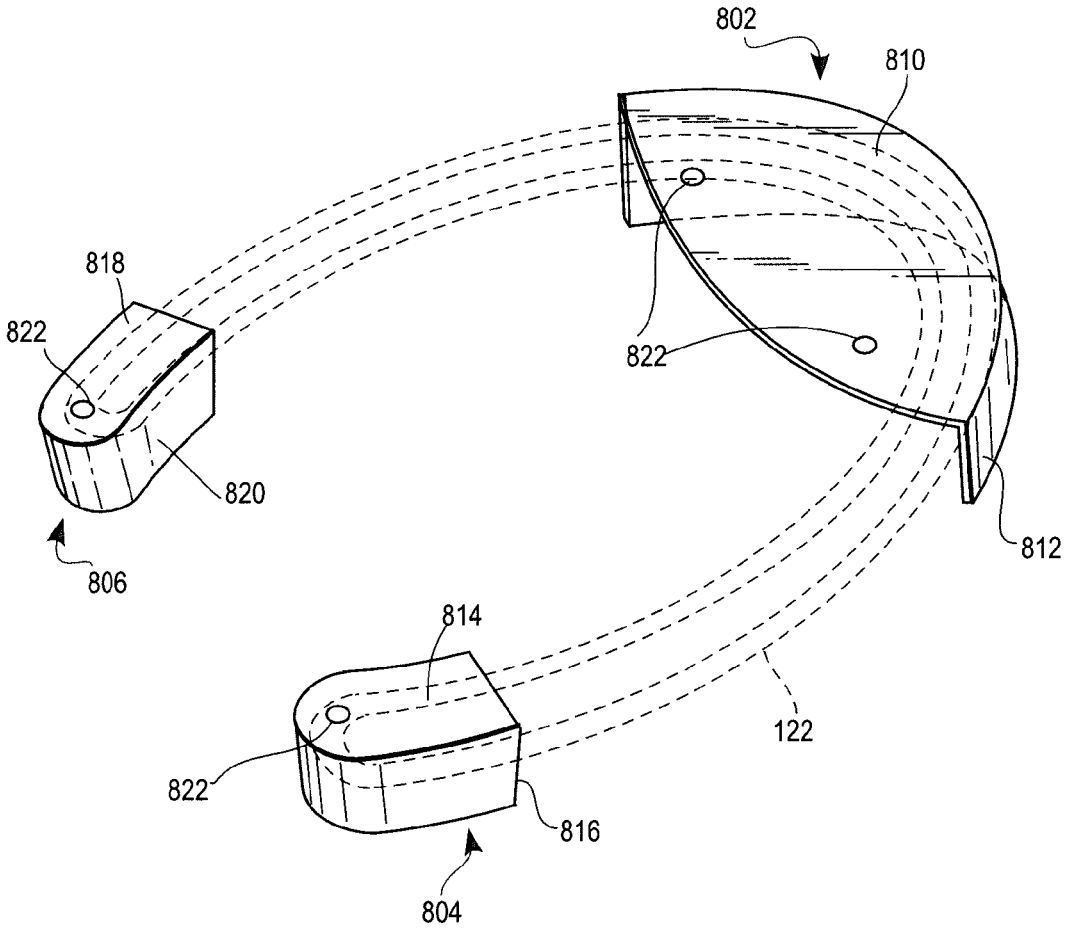
FIG. 8 is a perspective view of a bottom cover for the adult walker frame.

Referring next to FIG. 8, a bottom front horseshoe cover 802, a bottom right horseshoe cover 804 and a bottom left horseshoe cover 806 are shown according to one embodiment of the invention. The outline of the bottom horseshoe 122 is shown. The bottom front horseshoe cover 802 includes a bottom front cover top 810 and a bottom front cover side 812. The bottom right horseshoe cover 804 includes a bottom right cover top 814 and a bottom right cover side 816. The bottom left horseshoe cover 806 includes a bottom left cover top 818 and a bottom left cover side 820. Also shown are a plurality of bottom cover bolt holes 822. The bottom front cover top 810 is of shape and size to horizontally cover the bottom front plate 124 of the bottom horseshoe 122. The bottom front cover side 812 is coupled to and extends vertically downward from the front edge of the bottom front cover top 810. The vertical height of the bottom front cover side 812 is approximately 2.5 inches. The bottom right cover top 814 is of shape and size to horizontally cover the horseshoe right end as formed by the bottom horseshoe rails 178, 180 and the right bottom rear plate 140. The bottom right cover side 816 is coupled to and extends vertically downward from the edges of the bottom right cover top 814. The vertical height of the bottom right cover side 816 is approximately 2.5 inches. The bottom right cover side 816 starts near the outer front edge of the right bottom rear plate 140 and wraps around the outside of the bottom horseshoe 122, around the end of the horseshoe, and up the inside of the bottom horseshoe 122, stopping near the inner front edge of the right bottom rear plate 140. The bottom right cover side 816 thus forms a U-shape in plan. The bottom left horseshoe cover 806 is formed similarly to the bottom right horseshoe cover 804. The vertical sides of the bottom horseshoe covers 802, 804, 806 provide additional tipping prevention as the bottom horseshoe cover sides 812, 816, 820 will contact the floor when the adult walker 100 is rotated at a small angle relative to the floor, preventing the adult walker 100 from reaching an unstable angle.

Figure 9:
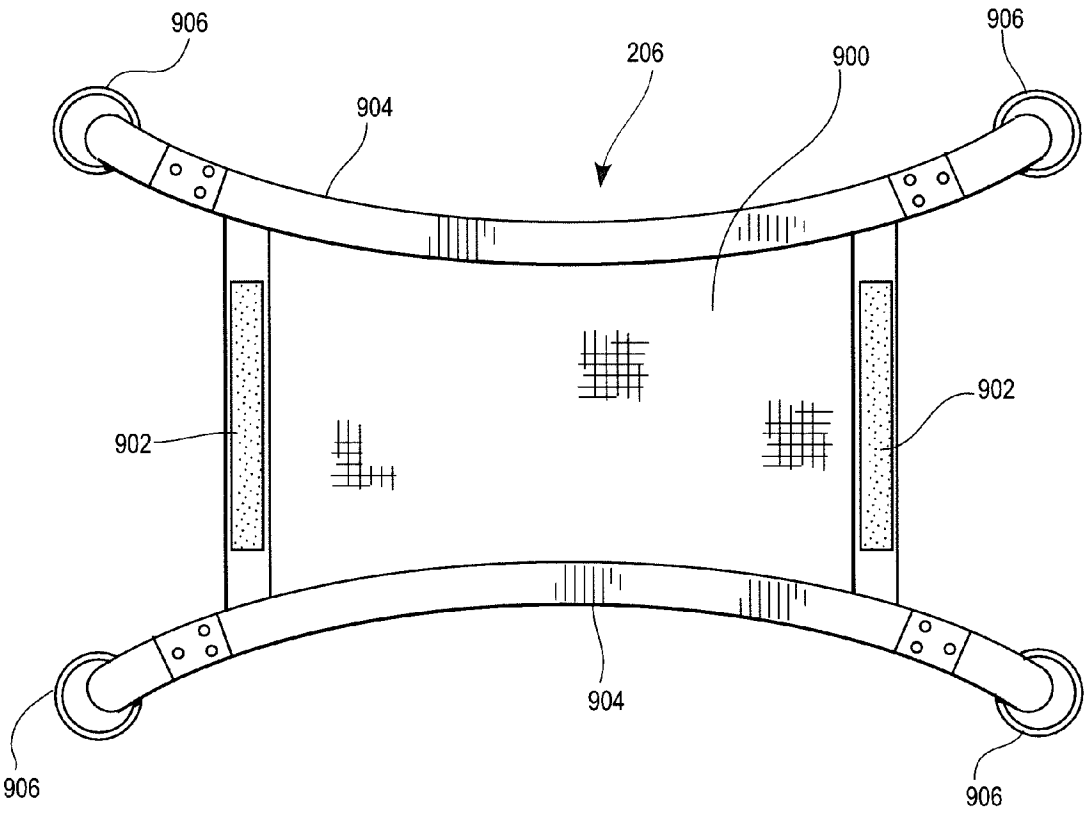
FIG. 9 is a plan detail of a seat.

Referring next to FIG. 9, an adult walker seat 206 in one embodiment is shown. Shown is a seat cushion 900, a plurality of loop or hook fastener tape strips 902, a plurality of seat support straps 904 and plurality of seat attachment rings 906. The seat cushion 900 is approximately rectangular in shape. On each side of the seat cushion 900, the seat support strap 904 is coupled to the seat cushion 900 and extends past the front and back of the seat cushion 900. The seat attachment ring 906 is coupled to each end of each strap, for a total of four rings. The seat 206 is attached to the adult walker 100 by using a plurality of carabiners to couple each seat attachment ring 906 to one of the eye hooks 204 on the top horseshoe 102. At the front of the seat cushion 900, the loop or hook fastener tape strip 902 is coupled to the top of the seat cushion 900. At the back of the seat cushion 900, the loop or hook fastener tape strip 902 is coupled to the top of the seat cushion 900. The seat cushion 900 is cushioned and in the preferred embodiment has a disposable nylon cover. The seat support straps 904 are made of leather, nylon or other suitable material.

Figure 10:
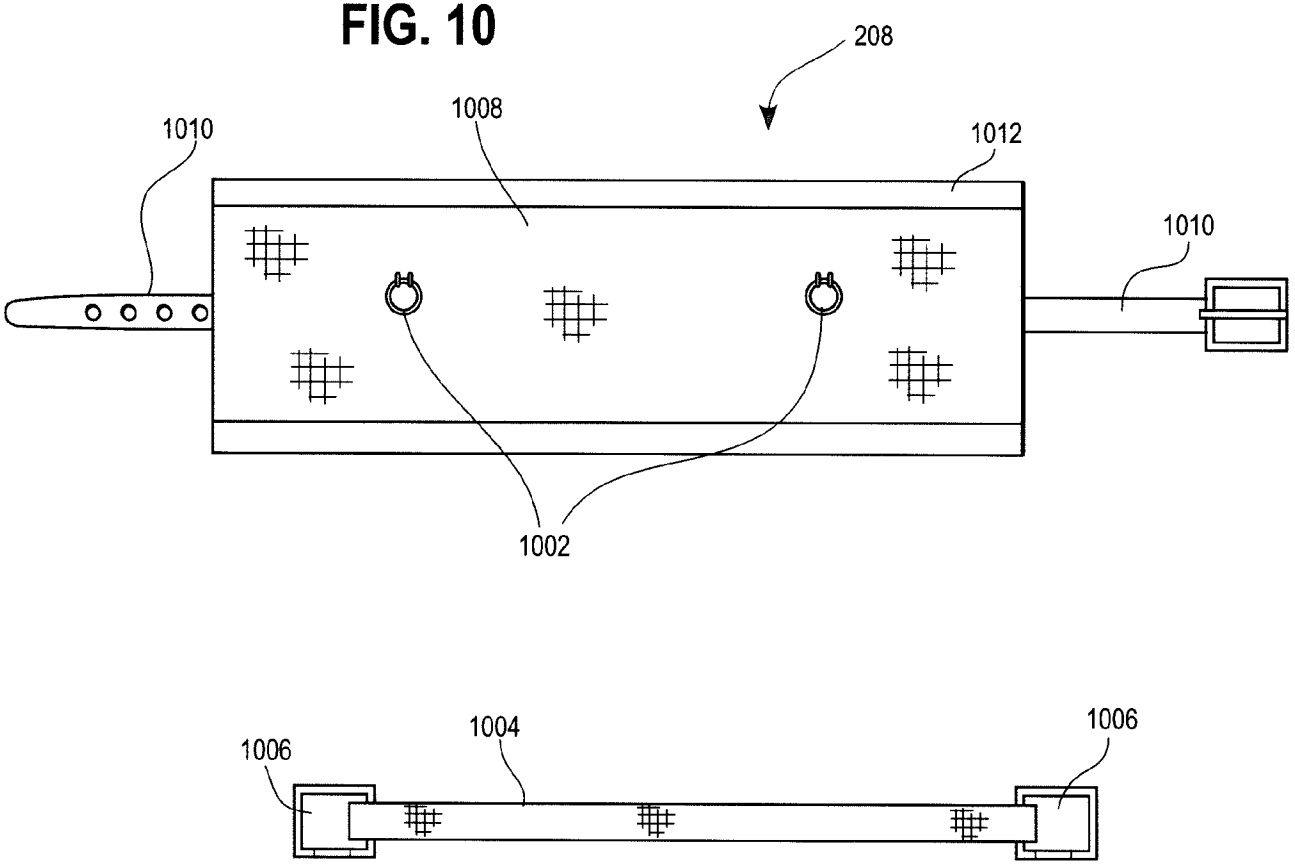
FIG. 10 is a detail of a support belt.

Referring next to FIG. 10, the adult walker 100 support belt 208 is shown. Shown are the belt 208, a plurality of belt rings 1002, a belt attachment 1004 and a plurality of belt carabineer attachments 1006. A middle belt portion 1008 of the support belt 208 is approximately 6 inches wide. A plurality of adjustable ends 1010 of the belt 208 are approximately 1-2 inches wide. Two belt rings 1002 are shown coupled to the middle portion 1008 of the outside of the support belt 208. A belt cushion 1012 is coupled to the inside of the middle belt portion 1008. The belt cushion 1012 in the preferred embodiment is approximately 8 inches wide, extends the full length of the middle belt portion 1008 with equal overhang above and below the middle belt portion 1008, and includes ½ inch foam covered with vinyl. The belt attachment 1004 is a strip approximately 10 inches long with the carabiner attachment 1006 on each end. One end of the belt attachment 1004 is coupled to one of the eye hooks 204 on the top horseshoe 102 and the other end is coupled to one of the belt rings 1002. When the support belt 208 is worn by the user, the attachment of the support belt 208 to the top horseshoe 102 will support the user in case of a fall, while the 6 inch belt width will help prevent back injury.

Figure 11:
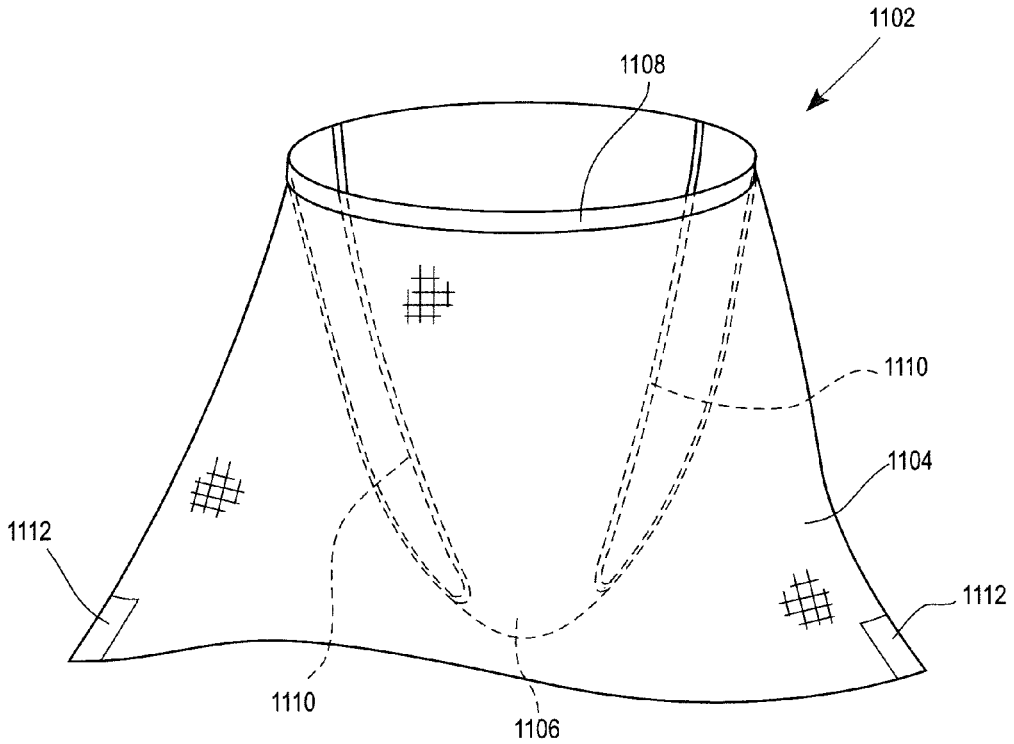
FIG. 11 is a detail of an incontinence garment.

Referring next to FIG. 11, an incontinence garment 1102 is shown. Shown is a fabric apron 1104, an excrement bag 1106, an elastic waist band 1108, a plurality of elastic crotch bands 1110 and a plurality of hook or loop tape fastener strips 1112. The elastic waist band 1108 is circular and fits around the user's waist. The fabric apron 1104 is shaped like a truncated cone, with the narrow end of the cone continuously coupled to the elastic waist band 1108. On the right side, one end of the elastic crotch band 1110 is coupled to and extends from the front right side of the elastic waist band 1108, down in a U-shape with the bottom of the U at the user's crotch level, and back up to the rear right side of the elastic waist band 1108, where it is coupled to the elastic waist band 1108. The elastic crotch band 1110 on the left side is similar. Between the elastic crotch bands 1110 is the excrement bag 1106, which is continuously coupled on each side to the elastic crotch bands 1110, at the front to the front of the elastic waist band 1108, and at the rear to the rear of the elastic waist band 1108. The excrement bag 1106 may be made of plastic or other suitable material. The hook or loop tape fastener strip 1112 is coupled to the bottom edge of the fabric apron 1104 on each side. The incontinence garment 1102 prevents soiling of the user, seat 206 or walker 100 due to incontinence, while providing for the modesty of the user. The hook or loop tape fastener strip 1112 on each side of the incontinence garment 1102 may be attached to the corresponding loop or hook tape 902 on the seat 206, securing the incontinence garment 1102 in place.

Figure 12:
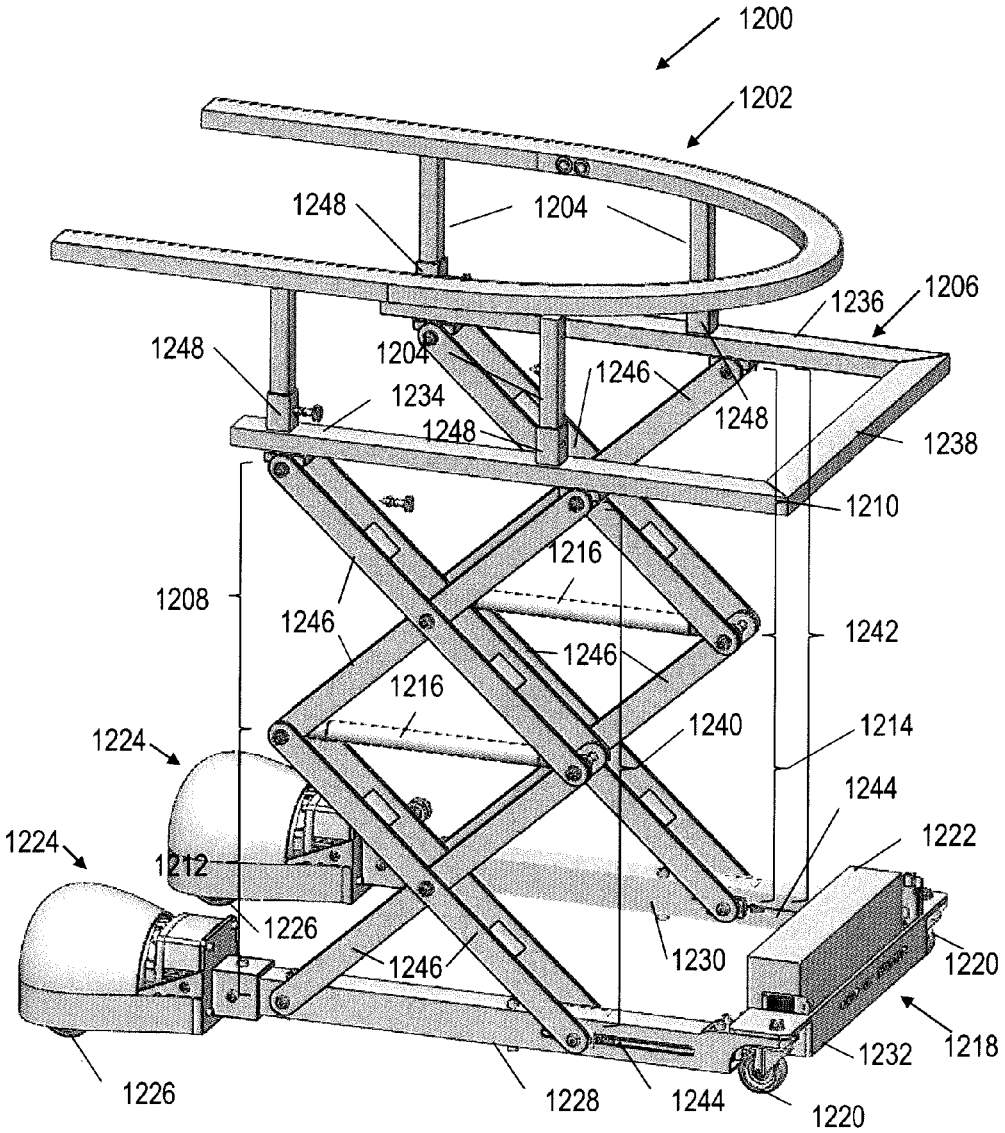
FIG. 12 is a perspective view of an adult walker apparatus in a fully raised position, in one embodiment of the present invention

Referring next to FIG. 12, a perspective view of an adult walker apparatus 1200 (also referred to as the walker 1200), in a fully raised position, in another embodiment of the invention is shown. The walker 1200 is shown in a fully raised position. Shown are a top horseshoe frame 1202, a plurality of vertical connectors 1204, an upper frame 1206, a top left scissor 1208, a top right scissor 1210, a bottom left scissor 1212, a bottom right scissor 1214, a plurality of gas springs 1216, a lower frame 1218, a plurality of front casters 1220, a battery pack 1222, a plurality of motor assemblies 1224, a plurality of rear wheels 1226, a left lower arm 1228, a right lower arm 1230, a lower front connector 1232, a left upper arm 1234, a right upper arm 1236, an upper front connector 1238, a right double scissor mechanism 1240, a left double scissor mechanism 1242, a plurality of horizontal slots 1244, a plurality of scissor legs 1246, a plurality of sockets 1248 and a plurality of attachment points 1250.

The lower frame 1218 is a general U-shape, oriented in a horizontal position, i.e. the U-shape is parallel to the ground. The lower frame 1218 is supported on the floor by the plurality of front casters 1220 coupled to a front portion of the lower frame 1218 and the plurality of rear wheels 1226 coupled to a rear portion of the lower frame 1218. The general U-shape of the present embodiment includes generally perpendicular corners, i.e. the lower frame 1218 includes the left lower arm 1228, the right lower arm 1230 parallel to the left lower arm 1228, and the lower front connector 1232 rigidly coupled to a front end of the left lower arm 1228 at a generally 90 degree angle, and rigidly coupled to a front end of the right lower arm 1230 at a generally 90 degree angle, whereby the rectilinear U-shaped lower frame 1218 is formed. In the embodiment shown in FIG. 12, the lower front connector 1232 includes a flange at each end of the lower front connector 1232, wherein each flange is mechanically coupled to a front end of the proximate lower arm. The lower front connector 1232 is configured to support the battery pack 1222, which in the present embodiment is coupled to an upper surface of the lower front connector 1232. The lower frame 1218 is of a suitably rigid and strong material, for example, aluminum, steel, or stainless steel. In some embodiments, if less strength is required (for example, in a non-powered embodiment) carbon fiber or other suitable material may be used.

Figure 14:
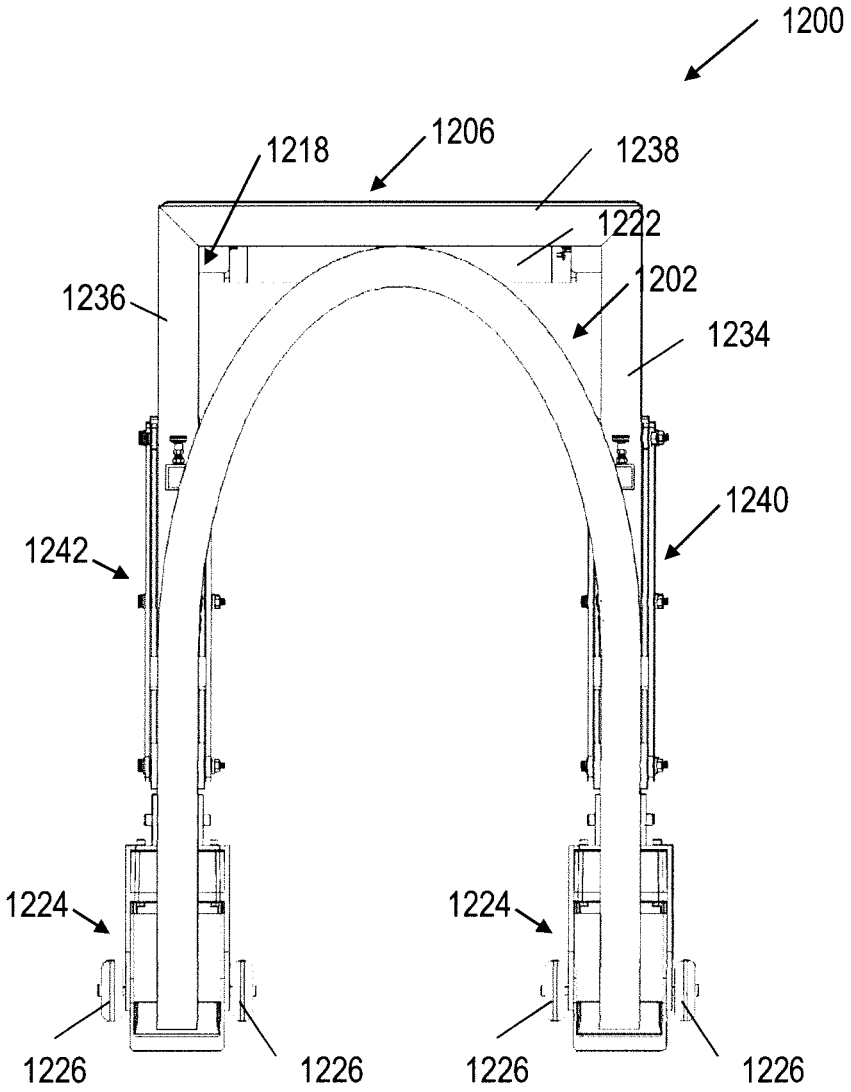
FIG. 14 is a top plan view of the walker in the fully raised position

The left lower arm 1228 and the right lower arm 1230 comprise a rectangular hollow tube-shaped housing. A scissor lift assembly 1618 is housed in each lower arm, as described further below. In lieu of the rectangular hollow tube shape, the lower arms 1228, 1230 may be any hollow shape suitable for housing the scissor lift assembly 1618. Each lower arm includes the horizontal slot 1244 in each vertical side of the housing. The horizontal slots 1244 are in a horizontal plane and located proximate to the front end. A length of the horizontal slots 1244 is configured to allow a connection to a front lower end of each bottom scissor 1212, 1214 to slide within the horizontal slots 1244 in the proximate lower arm, whereby each double scissor mechanism 1240, 1242 is enabled to move between the raised position of FIG. 12 and a lowered position (as shown in FIG. 14) by moving the connection from one end of the horizontal slot 1244 to an opposite end of the horizontal slot 1244, whereby the upper frame 1206 is raised or lowered.

At least two casters 1220 are coupled to an underside of the lower frame 1218. In the present embodiment the casters 1220 are located at the front corners of the lower frame 1218, i.e. one caster 1220 at each intersection of one lower arm 1228, 1230 and the lower front connector 1232.

One motor assembly 1224 is coupled to the rear end of each lower arm. One rear wheel is coupled to each lateral (i.e. left and right) side of each motor assembly 1224, for a total of four rear wheels 1226. Each motor assembly 1224 includes a motor housing 1616 rigidly coupled to the rear end of each lower arm and the lift motor coupled to and supported by the motor housing 1616, as described further below in FIG. 16. Each scissor motor 1600 is mechanically coupled to and controls the scissor lift assembly 1618 housed inside each lower arm. Each scissor motor 1600 is electrically coupled to the battery pack 1222 and a main controller 2104, which regulates the movement of the double scissor mechanisms and by simultaneously adjusting the left double scissor mechanism 1242 and the right double scissor mechanism 1240 via the sliding block 1612, varying the distance between the upper frame 1206 and the lower frame 1218 (i.e. raising and lowering the upper frame 1206).

The scissor motors 1600 in one embodiment are commercially available DC motors capable of operating at 12V-130V, and ⅐-½ HP.

The upper frame 1206 is a rectilinear U-shape of similar dimensions and orientation to the lower frame 1218 and located above and parallel to the lower frame 1218 such that the lower frame 1218 and upper frame 1206 align vertically. The upper frame 1206 is comprised of a hollow rectilinear tube section, although other suitable geometries may be used, for example a solid rectilinear section or a round tube section. The upper frame 1206 comprises the left upper arm 1234 and the right upper arm 1236 rigidly coupled to each end of the upper front connector 1238 at a normal angle. The upper frame 1206 may include attachment points for a harness, for example hooks. The upper frame 1206 is of a suitably rigid and strong material, for example, aluminum, steel, or stainless steel. As the upper frame 1206 does not require as much structural strength as the lower frame 1218, carbon fiber may also be used.

The left double scissor mechanism 1242 is juxtaposed between the left upper arm 1234 and the left lower arm 1228. The right double scissor mechanism 1240 is juxtaposed between the right upper arm 1236 and the right lower arm 1230. Each generally vertical double scissor mechanism 1240, 1242 includes the X-shaped top scissor 1208, 1210 stacked above and pivotally coupled to the corresponding X-shaped bottom scissor 1212, 1214, such that each double scissor mechanism 1240, 1242 may be extended upward vertically to the raised position of FIG. 12, or folded downward to the lowered (folded) position of FIG. 14. Each scissor 1208, 1210, 1212, 1214 includes two scissor legs 1246 crossed in the X-shape with a central pivot point, wherein the pivotal coupling of each top scissor 1208, 1210 to each bottom scissor 1212, 1214 includes pivotal coupling of proximate scissor leg 1246 ends.

Each double scissor mechanism 1240, 1242 is pivotally coupled at an intersection of a lower rear end of the bottom scissor 1212, 1214 and the rear portion of the corresponding lower arm 1228, 1230. Each double scissor mechanism 1240, 1242 is also pivotally coupled at an intersection of the lower front end of the bottom scissor 1212, 1214 and a front portion of the corresponding lower arm 1228, 1230. The coupling to the front portion of the corresponding lower arm 1228, 1230 also includes the horizontal sliding of the lower front end of the bottom scissor 1212, 1214 along the horizontal slot 1244, as previously described.

Similarly, each double scissor mechanism 1240, 1242 is pivotally coupled at the intersection of an upper rear end of each top scissor 1208, 1210 and a rear portion of the corresponding upper arm 1234, 1236. Each double scissor mechanism 1240, 1242 is also pivotally coupled at an intersection of an upper front end of the top scissor 1208, 1210 and a front portion of the corresponding upper arm 1234, 1236. Similar to the bottom scissors 1212, 1214, the coupling of the upper front end of the top scissor 1208, 1210 to the front portion of the corresponding upper arm 1234, 1236 also includes horizontal sliding of each upper front end of the top scissor 1208, 1210 along at least one horizontal slot 1244 of each upper arm 1234, 1236. In the embodiment shown, the at least one horizontal slot 1244 is located in an underside of each upper arm 1234, 1236.

In the current embodiment, each scissor leg 1246 is comprised of parallel bars rigidly coupled together by intermediate stitch plates. The distance between the bars is configured to allow the bars to couple to lateral sides of the upper arms 1234, 1236 and the lower arms 1228, 1230. In other embodiment the scissor legs 1246 may comprise a single member. The scissor legs 1246 may comprise carbon composite, carbon fiber, aluminum, titanium, stainless steel, steel, or other suitable material. In the embodiment shown, the pivotal-only connections are shoulder bolts 1900 sitting in a sleeve bearing/bushing to allow smooth operation of the scissor mechanism, as shown below in FIG. 20.

Each horizontally-oriented gas spring 1216 is juxtaposed between the scissor leg pivotal connections connecting each top scissor 1208, 1210 to the corresponding bottom scissor below 1212, 1214. The gas spring 1216 provides a linear horizontal contracting force between the scissor legs 1246 to aid in the raising of the upper frame 1206. The gas spring 1216 is described in more detail below in FIG. 20.

The top horseshoe frame 1202 above the upper frame 1206 and in a plane parallel to the upper frame 1206 is removably coupled to the upper frame 1206 via the plurality of vertical connectors 1204 coupled to a top face of the upper frame 1206. In one embodiment, a plurality of sockets 1248 are coupled to the top face of the upper frame 1206 and each vertical connector 1204 slides within one socket 1248 and is held in place using an automatically locking "pull-to-unlock" ball spring plunger. The vertical connectors 1204 are configured for adjustable height.

The top horseshoe frame 1202 has a horseshoe-like shape, with the legs of the horseshoe parallel, i.e. a conventional U-shape. A front end of the top horseshoe frame 1202 is set back from a front end of the upper frame 1206, and a rear end of the top horseshoe frame 1202 extends generally to a rear extent of the motor assemblies 1224 below, although it will be understood that other configurations of the top horseshoe frame 1202 may be suitable. In general, the horizontal components of the walker apparatus 1200, the upper frame 1206, the lower frame 1218, and the top horseshoe frame 1202 are configured to minimize the footprint of the walker 1200. The top horseshoe frame 1202 may comprise stainless steel, carbon fiber, or other material of suitable strength. A padding or cover may be coupled to the top horseshoe frame 1202. The top horseshoe frame 1202 includes the plurality of attachment points 1250 coupled to the underside of the top horseshoe frame 1202 and configured to attach to and support a seat, harness or other accessory.

Figure 13:
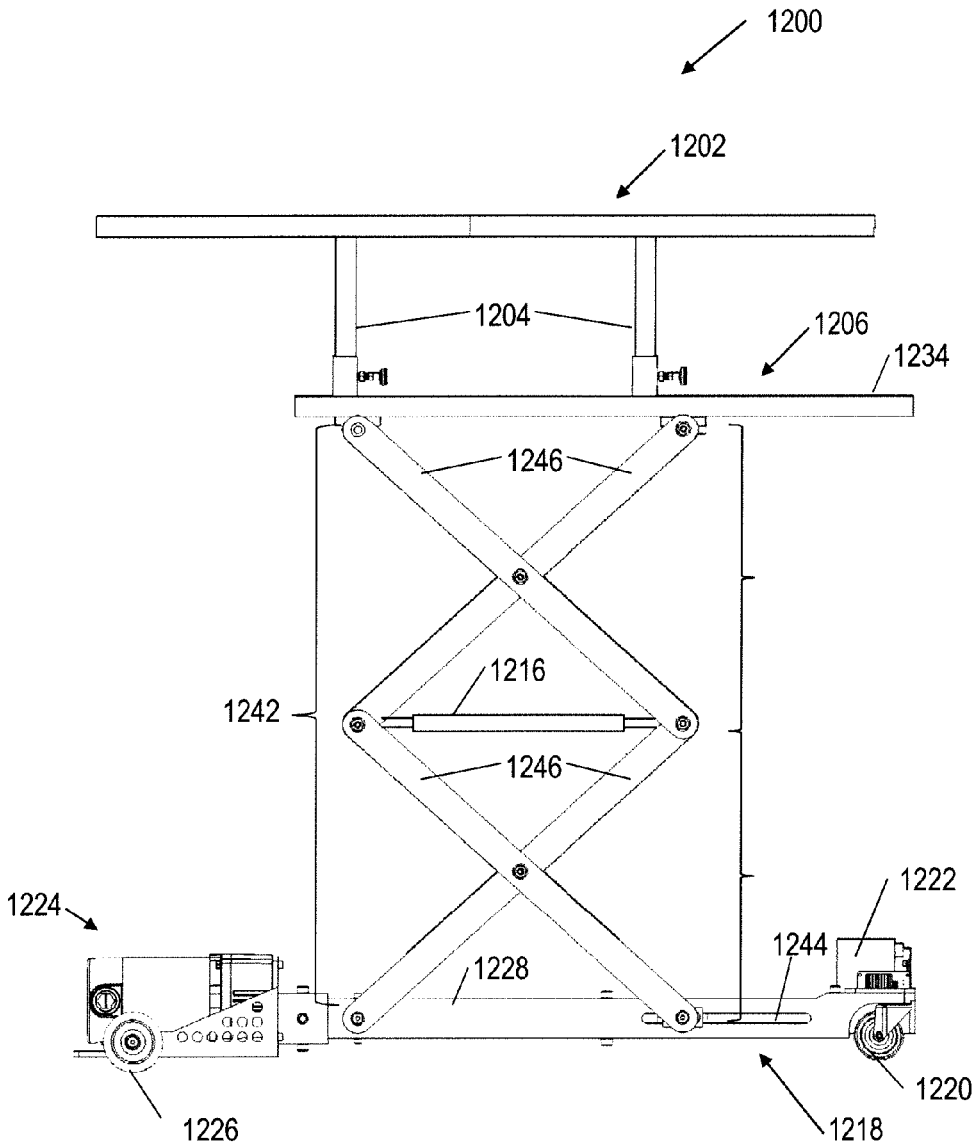
FIG. 13 is a left elevational view of the walker apparatus in the fully raised position

Referring next to FIG. 13, a left elevational view of the walker apparatus 1200 in the raised position is shown. Shown are the top horseshoe frame 1202, the plurality of vertical connectors 1204, the upper frame 1206, the top left scissor 1208, the bottom left scissor 1212, the of gas spring 1216, the lower frame 1218, the front caster 1220, the battery pack 1222, the motor assembly 1224, the rear wheel 1226, the left lower arm 1228, the lower front connector 1232, the left upper arm 1234, and the upper front connector 1238.

As previously described in FIG. 12, the walker 1200 comprises the horizontal lower frame 1218 coupled to the parallel horizontal upper fame 1206 by the double scissor mechanisms 1240, 1242 juxtaposed between the upper frame 1206 and the lower frame 1218. The connections of the double scissor mechanisms 1240, 1242 to the frames 1206, 1218 includes the pivoting connections at the rear portion of the frames 1206, 1218 and pivoting/sliding connections at the front portion of the frames 1206, 1218, allowing the double scissor mechanisms 1240, 1242 to extend forward while retracting from the raised position to the folded, or lowered, position.

Referring again to FIGS. 12 and 13, the walker apparatus 1200 includes the double scissor mechanisms 1240, 1242 which allows the walker 1200 to be raised to a height suitable for supporting the user while walking, while maintaining a compact footprint, thus allowing the folded walker apparatus 1200 to be easily transported. The top horseshoe frame 1202, the upper frame 1206 and the lower frame 1218 also include the U-shape open to the rear, allowing the user to easily enter the walker 1200 from the rear while still allowing the walker 1200 to mostly encircle the user, providing for support of the user around 3 sides. The user holds on to the top horseshoe frame 1202 during use of the walker 1200. A distance of the top horseshoe frame 1202 from the ground is lockably adjustable (at least by using the vertically adjustable vertical connectors 1204), and is configured so that the top horseshoe frame 1202 is generally above the iliac crest of the user, and ideally at elbow level. This height aids in preventing the user from falling out of the walker 1200. The top horseshoe frame 1202 is configured to provide a comfortable grip and hand/elbow and forearm support for the user. Padding or a cover may be coupled to the top horseshoe frame 1202 for added comfort and safety. In one embodiment the padding comprises anti-microbial fabric such as silver-impregnated fabric. In another embodiment the padding comprises neoprene. Attachment points 1250 are provided to the top horseshoe frame 1202 for a harness or seat (for example the seat 206 of FIG. 9 or the harness 3006 of FIG. 30) and/or storage compartments or trays. The top horseshoe frame 1202 and the vertical connectors 1204 may be removed from the walker 1200 in order to provide a more compact height in the folded position for ease of transport. In the current embodiment, the height of the folded walker 1200 (i.e. without the top horseshoe frame 1202 and the vertical connectors 1204) is generally less than 12 inches. The top horseshoe frame 1202 is set back from the front end of the walker 1200, promoting the user to be centered in the walker 1200, increasing stability of the walker 1200.

Several elements of the walker 1200 design prevent tipping of the walker 1200 when used by the user. The location of the motor assemblies 1224, the battery pack 1222, and a scissor lift assembly 1618 housed in each lower arm 1228, 1230 lower a center of gravity of the walker 1200 which provides a greater resistance to tipping. The swiveling front casters 1220 are located at the intersections of the lower arms 1228, 130 and the lower front connector 1232, increasing the side-to-side separation between the front casters 1220, increasing the lateral tipping moment resistance of the walker 1200. The frontmost location of the front casters 1220 increases the front-to-back tipping resistance of the walker 1200. The rear wheels 1226 are located at the rear end of the motor assemblies 1224 to provide the maximum distance from the front casters 1220, again increasing the front-to-back tipping resistance of the walker 1200. Additionally, two rear wheels 1226 are provided for each motor assembly 1224, one rear wheel 1226 on each side of each motor assembly 1224, providing additional stability and front-to-back and lateral tipping moment resistance. In the embodiment shown, each set of rear wheels 1226 coupled to the motor assembly 1224 are separated by 3 inches. Additionally, the rear wheels 1226 do not swivel, providing greater stability.

The lower frame 1218 clears the floor by a maximum of approximately ½", which also lowers the center of gravity of the walker 1200, and also prevents tipping by contacting the floor upon a small degree of rotation of the walker 1200 due to the closeness of the lower frame 1218 to the floor. The contact of the walker 1200 with the floor prevents the walker 1200 from rotating further and tipping.

These improvements increase the safety of the user by making the walker 1200 tip-proof under normal use, increasing the protection of the user against injury from falls due to tipping of the walker 1200.

In some embodiments, the coupling of the top horseshoe frame 1202 to upper frame 1206 includes connecting of an electrical circuit such that the walker 1200 is not powered unless the top horseshoe frame 1202 is coupled to the upper frame 1206. This allows the top horseshoe frame 1202 to be removed for transport while preventing powered use of the walker 1200 without the top horseshoe frame 1202.

Referring next to FIG. 14, a top plan view of the walker 1200 in the raised position is shown. Shown are the top horseshoe frame 1202, the upper frame 1206, the lower frame 1218, the battery pack 1222, the plurality of motor assemblies 1224, the plurality of rear wheels 1226, the left upper arm 1234, the right upper arm 1236, the upper front connector 1238, the right double scissor mechanism 1240, and the left double scissor mechanism 1242.

As previously described in FIGS. 12 and 13, the upper frame 1206, lower frame 1218, and top horseshoe frame 1202 are vertically aligned to minimize the footprint of the walker apparatus 1200. The overall U-shape of the walker 1200 in plan view surrounds the user on the left, right and front sides. The U-shape including the open rear side of the walker apparatus 1200 allows the user to easily enter and exit the walker 1200 from the rear, while providing support for the user on the remaining three sides.

Figure 15:
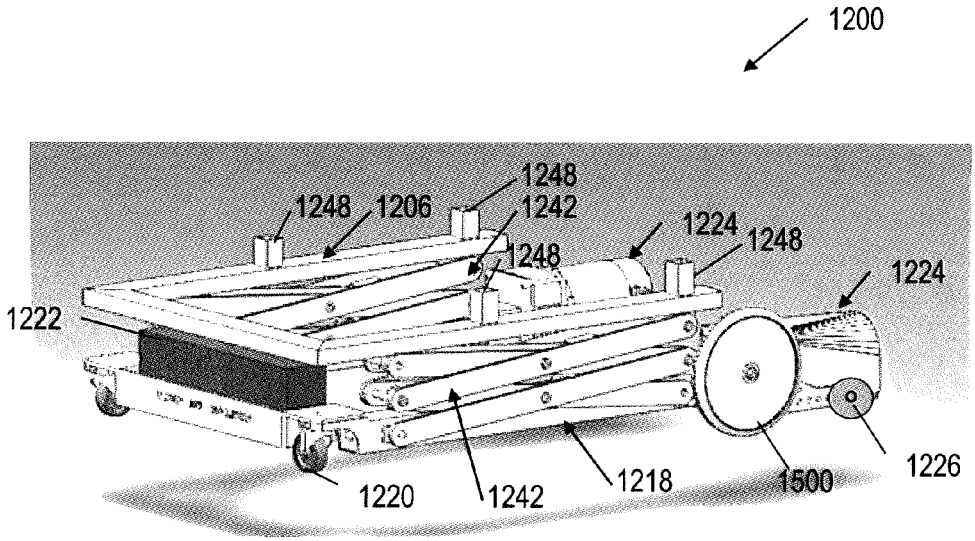
FIG. 15 is a perspective view of the walker in the folded position.

Referring next to FIG. 15, a perspective view of the walker 1200 in the folded position is shown. Shown are the upper frame 1206, the top left scissor 1208, the bottom left scissor 1212, the top right scissor 1210, the bottom right scissor 1214, the lower frame 1218, the plurality of front casters 1220, the battery pack 1222, the plurality of motor assemblies 1224, the back wheel 1226, the left lower arm 1228, the lower front connector 1232, the left upper arm 1234, the upper front connector 1238, and the plurality of sockets 1248, and a drive wheel 1500.

As previously described, the walker 1200 folds down into the lowered position for storage or transport in response to the movement of the double scissor mechanisms 1240, 1242. The top horseshoe frame 1202 and the vertical connectors 1204 have been removed in the embodiment shown, illustrating the minimum height of the walker 1200 in the folded position. The top horseshoe frame 1202 and the vertical connectors 1204 may be left on in the folded position, although it will increase the height of the folded walker 1200 apparatus.

As previously described, the walker apparatus 1200 is moved from the raised to the lowered position (and vice versa) by simultaneous horizontal moving of the lower front end of each bottom scissor 1212, 1214, resulting in the raising of the double scissor mechanisms 1240, 1242 (if the lower front end of each bottom scissor 1212, 1214 is moved rearward) or the lowering of the double scissor mechanism 1240, 1242 (if the lower front end of each bottom scissor 1212, 1214 is moved frontward). The lower front end of each bottom scissor 1212, 1214 is connected to one motor assembly 1224, as described further below in FIG. 16.

Figure 16:
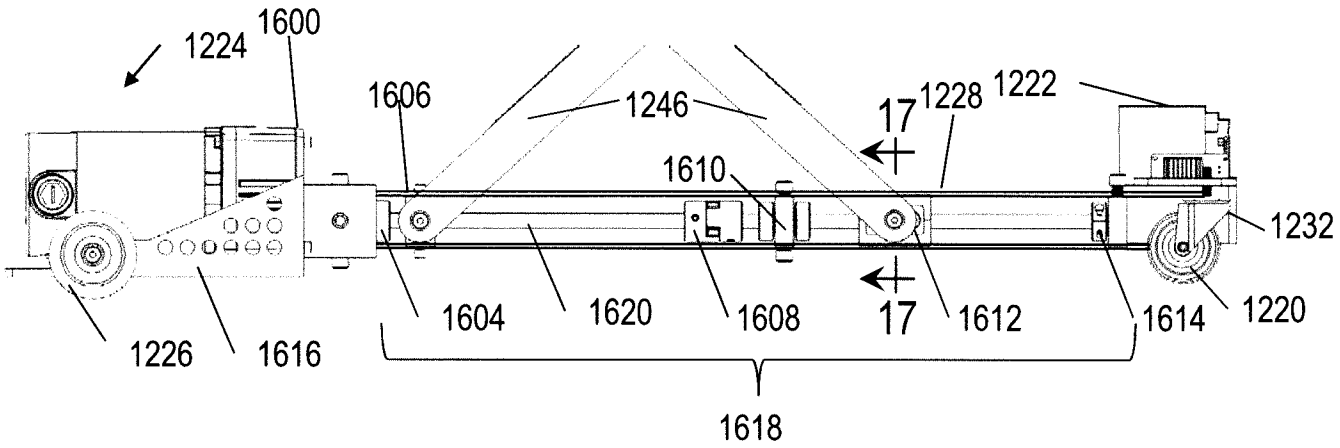
FIG. 16 is a side view of a scissor lift assembly of the walker in one embodiment of the present invention.

Referring next to FIG. 16, a side view of a scissor lift assembly 1618 located inside the left lower arm 1228 is shown. Shown are the left lower arm 1228, the motor assembly 1224, a scissor motor 1600, a threaded rod 1602, a first coupler 1604, a first bearing block 1606, a second coupler 1608, a second bearing block 1610, a sliding block 1612, a third bearing block 1614, the motor housing 1616, and a motor shaft 1620.

While only the scissor lift assembly 1618 inside the left lower arm 1228 is shown, it will be understood that a corresponding scissor lift assembly 1618 is housed within the right lower arm 1230 and functions in the same way.

One scissor lift assembly 1618 is housed within each lower arm 1228, 1230. An output shaft (not shown) of the scissor motor 1600 is aligned axially with and coupled to the non-threaded motor shaft 1620 via the first coupler 1604, whereby rotation of the output shaft is transferred to the motor shaft 1620.

The motor shaft 1620 passes through a hole in the first bearing block 1606. The first bearing block 1606 is juxtaposed between the first coupler 1604 and the second coupler 1608, and is configured to provide radial support to the motor shaft 1620 and provide the pivotal coupling to the lower scissor leg end proximate to the rear of the corresponding lower arm 1228, 1230. In one embodiment, the first bearing block 1606 comprises a steel block with a press fit iolite flange bushing or sleeve bearing. The first bearing block 1606 provides radial (i.e. vertical and horizontal) bearing support to the threaded rod 1602 but not axial bearing support. One first bearing block 1606 is coupled to each lower arm 1228, 1230 with hardened screws or bolts.

The motor shaft 1620 and the threaded rod 1602 are axially aligned and coupled together with the second coupler 1608, whereby the rotation of the motor shaft 1620 is transferred to the threaded rod 1602. In other embodiments a continuous length of threaded rod 1602 may be used, or other numbers of splices and/or splice locations may be used, as compatible with the rest of the assembly 1618. In the embodiment shown in FIG. 16, the second coupler 1608 is a Lovejoy coupling. In the embodiment shown in FIG. 16, ½"-¾" diameter threaded rod 1602 is used. The threaded rod 1602 and the motor shaft 1620 are comprised of stainless steel, steel, or other suitable material.

The threaded rod 1602 passes through a hole in the second bearing block 1610. The second bearing block 1610 is juxtaposed between the second coupler 1608 and the sliding block 1612. The second bearing block 1610 is configured to provide both radial and axial support to the threaded rod 1602 as the threaded rod 1602 passes through the second bearing block 1610. In the present embodiment, the second bearing block 1610 includes annular thrust bearings on the front and rear sides of the second bearing block 1610, with the threaded rod 1602 passing through the thrust bearings. The second bearing block 1610 also includes a non-threaded sleeve bearing for radial support. The threaded rod 1602 is held in place with a threaded-bore clamp-on shaft collars. The combination of the thrust bearings and the sleeve bearing allows the threaded rod 1602 to rotate with low friction, and holds the threaded rod 1602 in place axially. The second bearing block 1610 also enables axial load to be transferred from the threaded rod 1602 to the second bearing block 1610 to the corresponding lower arm 1228, 1230.

The custom sliding block 1612 encircles the threaded rod 1602 and is configured snugly fit within and to slide within the lower arm 1228. The custom sliding block 1612 is coupled to the front lower end of the proximate bottom scissor 1212, 1214 through the horizontal slots 1244 in the lateral sides of the lower arm 1228, thus confining horizontal movement of the sliding block 1612 to the extent of the horizontal slot 1244. Additionally, the pivotal coupling of the sliding block 1612 to the scissor leg 1246 moves the scissor leg end as the sliding block 1612 moves horizontally in the corresponding lower arm 1228, 1230.

The custom sliding block 1612 includes a threaded hole to receive the threaded rod 1602, whereby when the threaded rod 1602 is rotated by the scissor motor 1600, the sliding block 1612, being restrained against rotation by the lower arm 1228, moves horizontally along the threaded rod 1602, moving the sliding block 1612 within the horizontal slot 1244, whereby the double scissor mechanism 1240, 1242 is raised or lowered.

The threaded rod 1602 continues in the corresponding lower arm 1228, 1230 until it terminates at the third bearing block 1614 proximate to the front end of the corresponding lower arm 1228, 1230. The third bearing block 1614 is configured to provide both radial and axial support to the threaded rod 1602. In the present embodiment, the third bearing block 1614 includes thrust bearings on the front and rear sides of the third bearing block 1614. The threaded rod 1602 is held in place by the third bearing block 1614 by threaded bore clamp-on collars. As with the second bearing block 1610, the third bearing block 1614 allows the threaded rod 1602 to rotate with low friction, and holds the threaded rod 1602 in place axially. The second bearing block 1610 also enables axial load to be transferred from the threaded rod 1602 to the third bearing block 1614 to the corresponding lower arm 1228, 1230.

Figure 17:
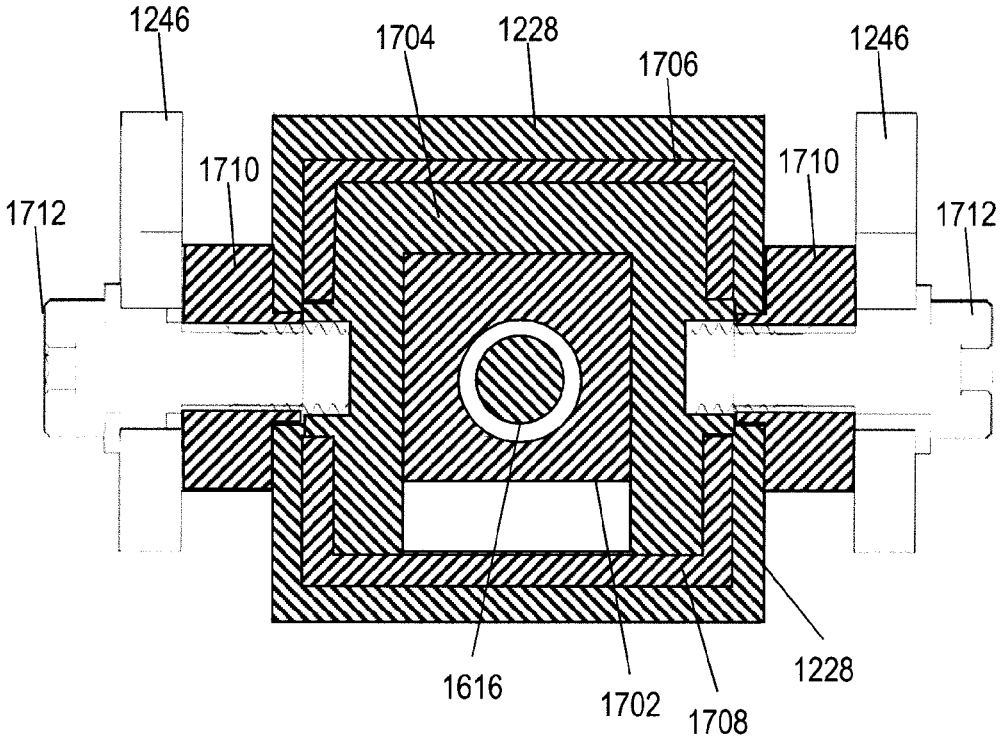
FIG. 17 is a sectional view of a sliding block of the scissor lift assembly in one embodiment of the present invention.

Referring next to FIG. 17, a sectional view of the sliding block 1612 in the left lower arm 1228 is shown. Shown are the scissor lift the threaded rod 1602, the plurality of bars of the scissor leg 1246, a center square nut 1702, a center block 1704, a first outer casing 1706, a second outer casing 1708, a plurality of side yokes 1710, and a plurality of screws 1712, and the left lower arm 1228.

Although only the sliding block 1612 inside the left lower arm 1228 is shown, it will be understood that a similar scissor lift assembly 1618 including the sliding block 1612 is also located within the right lower arm 1230. The sliding block 1612 includes the threaded center square nut 1702. The threaded rod 1602 is screwed through the center square nut 1702, whereby the rotational movement of the threaded rod 1602 is translated into horizontal movement of the center square nut 1702. The center square nut 1702 is encased in the center block 1704, which includes axially aligned front and rear holes to allow the threaded rod 1602 to pass though the center block 1704. The center square nut 1702 and the center block 1704 comprise steel, aluminum or other suitable material. The first outer casing 1706 fits over a top portion of the center block 1704, and the second outer casing 1708 fits over a bottom portion of the center block 1704, forming a general cube shape, with front and back notches to allow the threaded rod 1602 to pass by the first outer casing 1706 and the second outer casing 1708. The first outer casing 1706 and the second outer casing 1708 comprise PTFE (e.g. Teflon™), acetal resin (e.g. Delrin®) or other lubricant material. The lubricant material provides a lower coefficient of friction, allowing the sliding block 1612 to slide freely within one lower arm 1228, 1230. The lubricant material also prevents galling.

Each tee-shaped side yoke 1710 is coupled to a side of the center block 1704 through the horizontal slot 1244, such that the tee-flange portion of each side yoke 1710 is outside the lower arm 1228. The tee stem of each side yoke 1710 passes through the horizontal slot 1244 and is coupled to a side of the center block 1704. In the present embodiment the connection comprises three screws 1712 for each side yoke 1710, with each side yoke 1710 including two threaded screw through holes. Each side yoke 1710 is also pivotally coupled to the proximate bar of the scissor leg 1246. The side yokes 1710 comprise steel, aluminum or other suitable material.

Referring again to FIG. 17, the sliding block 1612 comprises an assembly surrounding the center square nut 1702 for a number of reasons. The sliding block 1612 comprised of the assembled elements results in easier fabrication. The use of the conventional center square nut 1702 allows a readily available element to be seated within the custom-shaped center block 1704, and also prevents a fabrication requirement of machining internal threads in the center block 1704. The use of separate side yokes 1710 allows the sliding block 1612 to be assembled and placed within one lower arm 1228, 1230, then slidingly coupled to the lower arm 1228, 1230 by the coupling of the side yokes 1710 to the sliding block 1612.

Figure 18:
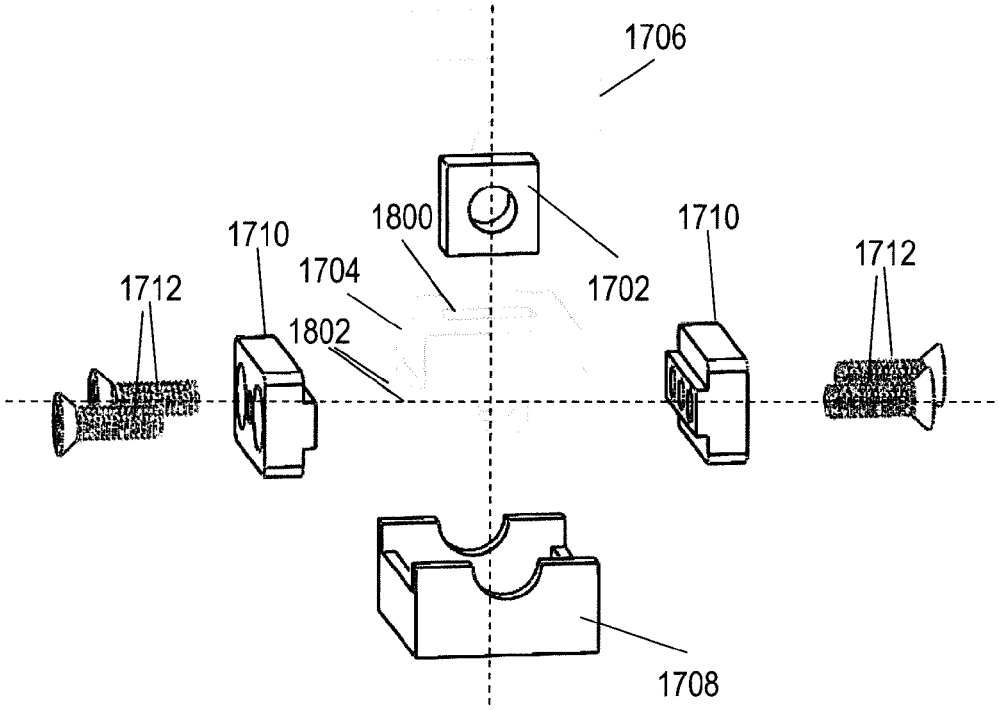
FIG. 18 is an exploded view of the sliding block of the scissor lift assembly.

Referring next to FIG. 18, an exploded view of the sliding block 1612 is shown. Shown are the center square nut 1702, the center block 1704, the first outer casing 1706, the second outer casing 1708, the plurality of side yokes 1710, and the plurality of screws 1712.

As previously described in FIG. 17, the sliding block 1612 is comprised of the center square nut 1702 that is slid within the center block 1704 via a vertical center block slot 1800 in the center block 1704. The center block 1704 includes two threaded holes 1802 on each outer side juxtaposed with the lower arm 1228, 1230 side when the sliding block 1612 is fitted within the lower arm 1228, 1230. The first outer casing 1706 and the second outer casing 1708 fit over the top portion of the center block 1704 and the bottom portion of the center block 1704, respectively. In the embodiment shown, the threaded holes 1802 are located in a raised portion of the center block 1704. The outer casings 1706, 1708 are configured to abut the raised portion of the center block 1704 and form a continuous plane with the raised portion of the center block 1704 when the outer casings 1706, 1708 are installed on the center block 1704.

Each side yoke 1710 is coupled to a side of the center block 1704 by the threaded screws 1712 threaded into the threaded holes 1802 and screwed into corresponding threaded holes in each side of the center block 1704. The side yokes 1710 are oriented with the tee-flange in a vertical orientation, and the tee-stem oriented horizontally.

Figure 19:
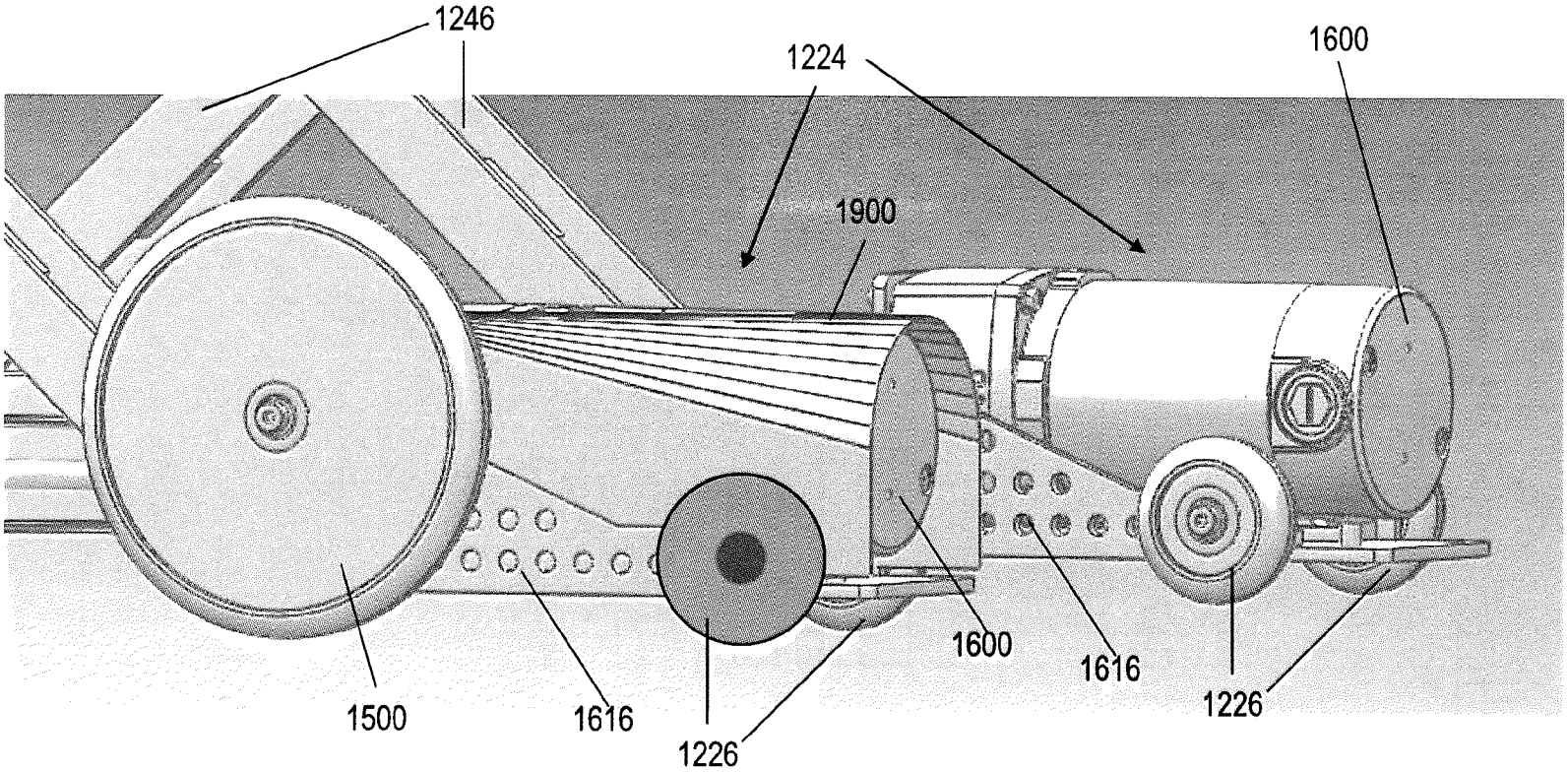
FIG. 19 is a perspective view of a motor assembly of the walker in one embodiment of the present invention.

Referring next to FIG. 19, a perspective view of an embodiment of the motor assembly 1224 including the drive wheel 1500 is shown. Shown are the motor assemblies 1224, the plurality of rear wheels 1226, the plurality of scissor legs 1246, the plurality of motor housings 1616, the plurality of scissor motors 1600, the drive wheel 1500, and a motor cover 1900.

With the exception of the added drive wheel 1500, the scissor motor assembly 1224 of FIG. 19 is the same as for the embodiment of the walker 1200 as shown in FIG. 12, i.e. without the drive wheels 1500. The addition of the drive wheels 1500 is an optional embodiment of the walker apparatus 1200. Each scissor motor 1600 is coupled to and supported by one motor housing 1616. Each motor housing 1616 is rigidly coupled to the rear end of the proximate lower arm 1228, 1230 and configured to allow the threaded rod 1602 rotationally coupled to the scissor motor 1600 to pass through the housing to the interior of the lower arm 1228, 1230. Each motor housing 1616 also supports the rear wheel on each side of the motor housing 1616, for a total of four wheels. The wheels include standard bearings to provide a low rolling resistance. The motor assembly 1224 may also include the motor cover 1900 mounted over the scissor motor 1600 to protect the scissor motor 1600 and prevent injury to the user.

In the embodiment of FIG. 19, at each motor assembly 1224 one large diameter drive wheel 1500 is rotationally coupled to and powered either by the scissor motor 1600 or by an additional drive motor 2114. The drive wheel 1500 is coupled to the outside side face of the motor housing 1616 at a location to avoid conflict with the rear wheel coupled to the outside side face of the motor housing 1616. The drive motor 2114 may be the motor for the scissor lift assembly 1618 (with an additional gear box coupled to the motor) or may be a separate motor also coupled to the motor housing 1616. The drive wheels 1500 are controlled by a drive motor/controller 2112 electrically coupled to each drive motor 2114 and the main controller 2104 (as shown below in FIG. 22).

For the drive wheel embodiment, at least one accelerometer and/or other motion sensor is coupled to the main controller 2104 to sense when the walker 1200 is being pushed forward by the user. In response to detecting forward motion of the walker 1200, the main controller 2104 would direct drive motors 2114 to power the drive wheels 1500, providing additional forward motion, assisting the user in moving the walker 1200 forward, for example when going up a ramp. When used on a level surface, the drive wheels 1500 reduce the force needed to move the walker 1200 forward, aiding the user with limited pushing ability. The controller may also provide a rearward motion to provide a braking force when the walker 1200 is going down a ramp.

In some embodiments when one harness configured to support the user in a seated position is coupled to the walker 1200, the walker 1200 may be used as a short distance low speed scooter or wheelchair. In one embodiment only the drive motors 2114 are used to propel the walker 1200 forward, with no assistance from the user. In another embodiment, the user provides some forward propulsion by pedaling forward with one or both feet while seated in the harness. In yet another embodiment, a caretaker pushes the walker 1200 forward while the user is seated in the harness while the drive motors 2114 are used to propel the walker 1200 forward, providing a more rapid movement than by using the drive motors 2114 alone.

Figure 20:
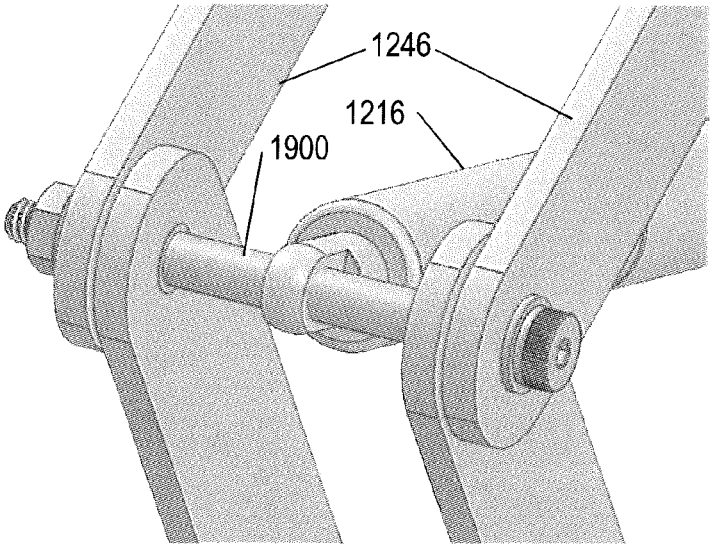
FIG. 20 is a perspective view of a scissor leg connection of the walker apparatus.

Referring next to FIG. 20, a perspective view of the scissor leg connection is shown. Shown are the scissor legs 1246, the gas spring 1216, and the shoulder bolt 1900.

As previously described, each scissor leg 1246 comprises two longitudinal parallel bars coupled together at intermediate intervals by stitch plates. At the pivotal connection between one top scissor 1208, 1210 and one bottom scissor 1212, 1214, a lower end of each bar of the top scissor leg 1246 overlaps an upper end of the proximate bar of the bottom scissor leg 1246. The pivotal connection is made by the high strength shoulder bolt 1900 passing through a hole in an end of each bar. The bolt also is pivotally connected to an end of the gas spring 1216, with the connection occurring between the parallel bars.

The gas spring 1216 is a standard contraction gas spring, with an extension ranging between 5 and 10 inches. In the present embodiment, an overall length of the gas spring 1216 is 12 inches when fully compressed and 22 inches when fully extended. As described previously, the gas spring 1216 provides the contractive force on the scissor leg connection, aiding in the raising of the double scissor mechanism 1240, 1242 and allowing the size of the scissor motor 1600 to be reduced.

Figure 21:
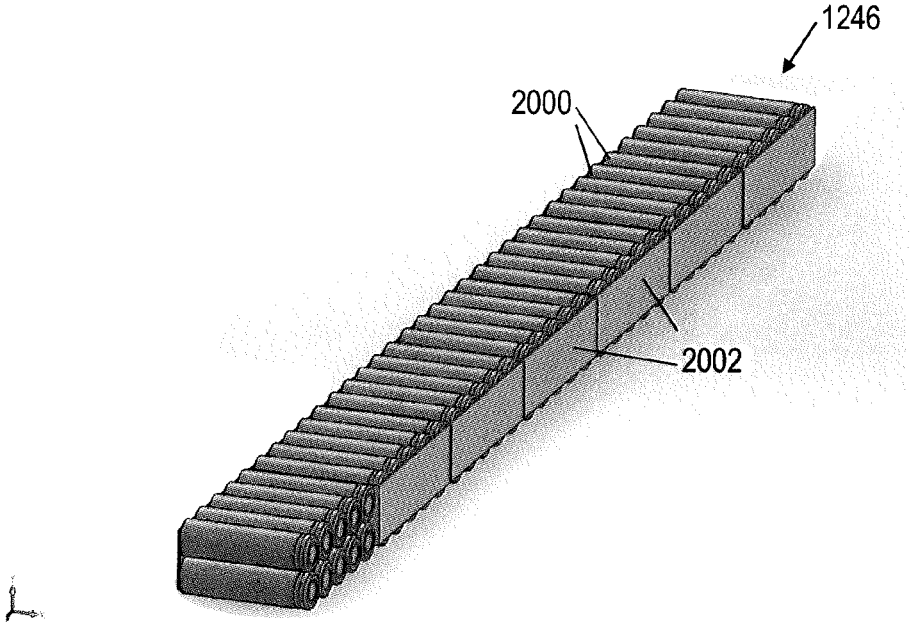
FIG. 21 is a perspective view of a battery pack of the walker apparatus in one embodiment of the present invention.

Referring next to FIG. 21, a perspective view of the battery pack 1222 of the walker 1200 is shown in one embodiment of the present invention. Shown are a plurality of rechargeable batteries 2000 and a plurality of shims 2002.

The battery pack 1222 is comprised of the plurality of rechargeable batteries 2000, for example lithium ion. The batteries 2000 are arranged in a 7S configuration with the number of cells required to provide the necessary voltage to the scissor motors 1600 and other components receiving power from the battery pack 1222. In the present embodiment, the battery pack 1222 comprises a 24-48V battery with a capacity of 5-30 Ah. The batteries 2000 are arranged in a low rectangular shape to fit on top of the lower front connector 1232. A plurality of conductive shims 2002 connect each battery 2000 in the battery pack 1222 and provide attachment for charging. The battery pack 1222 is removably housed within a battery housing coupled to the lower frame 1218, and the connection of the battery pack 1222 to the other components is designed to allow for hot swapping. The battery pack 1222 is configured for balanced charging and to prevent thermal runaway. In some embodiments each drive motor/controller 2112 is mounted to the lower front connector 1232 proximate to the battery pack 1222, although the drive motor/controllers 2112 may be mounted at other locations on the lower frame 1218.

Figure 22:
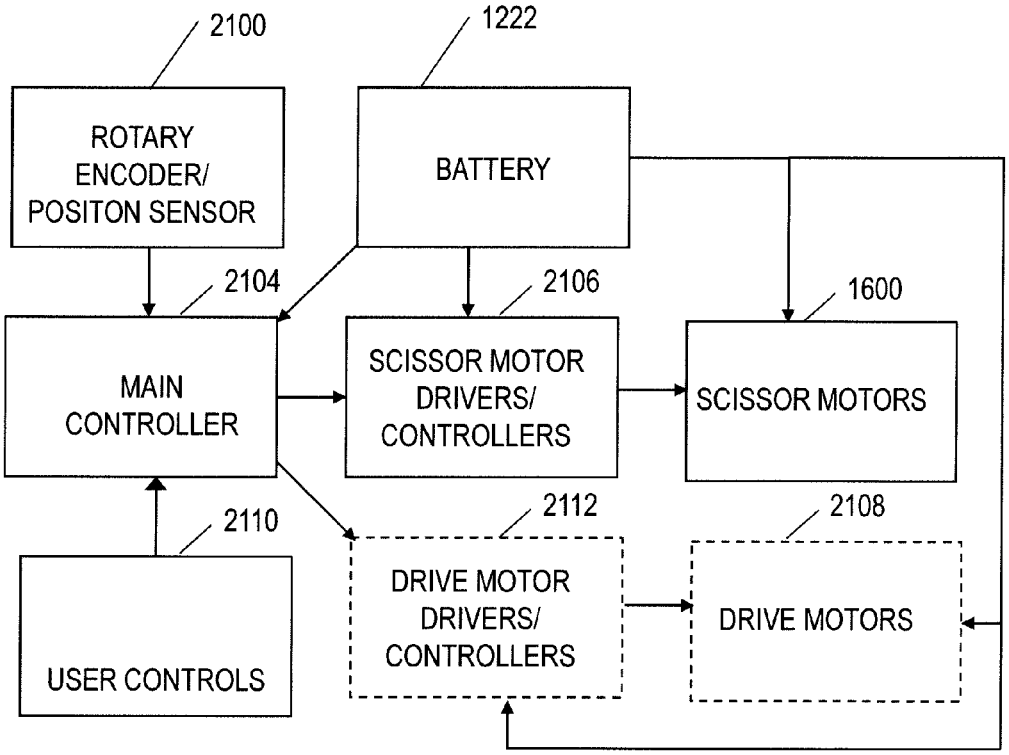
FIG. 22 is a schematic diagram of a walker control system of the walker apparatus.

Referring next to FIG. 22, a schematic diagram of a walker control system for operating the walker apparatus 1200 is shown. Shown are a rotary encoder/position sensor 2100, the battery pack 1222, the main controller 2104, a scissor motor driver/controller 2106, scissor motors 1600, user controls 2110, the optional drive controller 2112, and the optional drive motors 2114.

The battery pack 1222, as previously described, provides power to the various components, including the main controller 2104, the scissor motor driver/controller 2106, the scissor motors 1600, the optional drive controller 2112, and the optional drive motors 2114. In some embodiments back-up batteries may additionally be coupled to one or more of the components, such as a 9V DC cell for backup for the main controller 2104.

The main controller 2104 is comprised of a computing device including a processor, non-transitory memory coupled to the processor, and software stored on the non-transitory memory and configured to run on the processor. In one embodiment the main controller 2104 is configured to allow for additional non-transitory memory to be coupled to the main controller 2104. The software includes programming that monitors motor parameters control the movement of the double scissor mechanisms 1240, 1242 based on input from the user controls 2110 communicatively coupled to the main controller 2104. The software is also configured to receive input from the rotary encoder/position sensor 2100 to monitor the motor parameters (e.g.) speed. The rotary encoder/position sensor 2100 may be built in to the scissor motor 1600 or may be a custom-made encoder. The custom-made encoder may comprise either a Hall effect sensor and gear, or an optical sensor and gear. The software includes a control algorithm to control the speed of the motors, sending signals to the motor driver/controller 2106 communicatively coupled to main controller 2104, whereby the speed of the motor is regulated. The main controller 2104 includes power isolation or power condition so that in rush motor current draw does not power off the main controller 2104.

The scissor motor driver/controller 2106 is configured to control the scissor motor 1600 coupled to the scissor motor driver/controller 2106 in response to receiving signals from the main controller 2104. Each scissor motor driver/controller 2106 is mounted on the lower frame 1218 to enable heat dissipation. The scissor motor driver/controller 2106 may be a commercially available product or may be custom made. In one embodiment the scissor motor driver/controller 2106 is a dual 25A motor driver with 25 A continuous current capacity and a peak current capacity of 50 A. In the embodiment shown, the scissor motor driver/controller 2106 is configured for motors with a 6-30V nominal voltage range, but in other embodiments the range may vary between 12-96V.

The software may be configured to store at least one intermediate walker setting so that the walker 1200 may be automatically adjusted to one or more pre-set heights. The intermediate walker settings would be set and accessed via the user controls 2110. The main controller 2104 may also be configured for communication with an outside network, for example, to send an alert if a stop control button 2208 is pressed.

Figure 23:
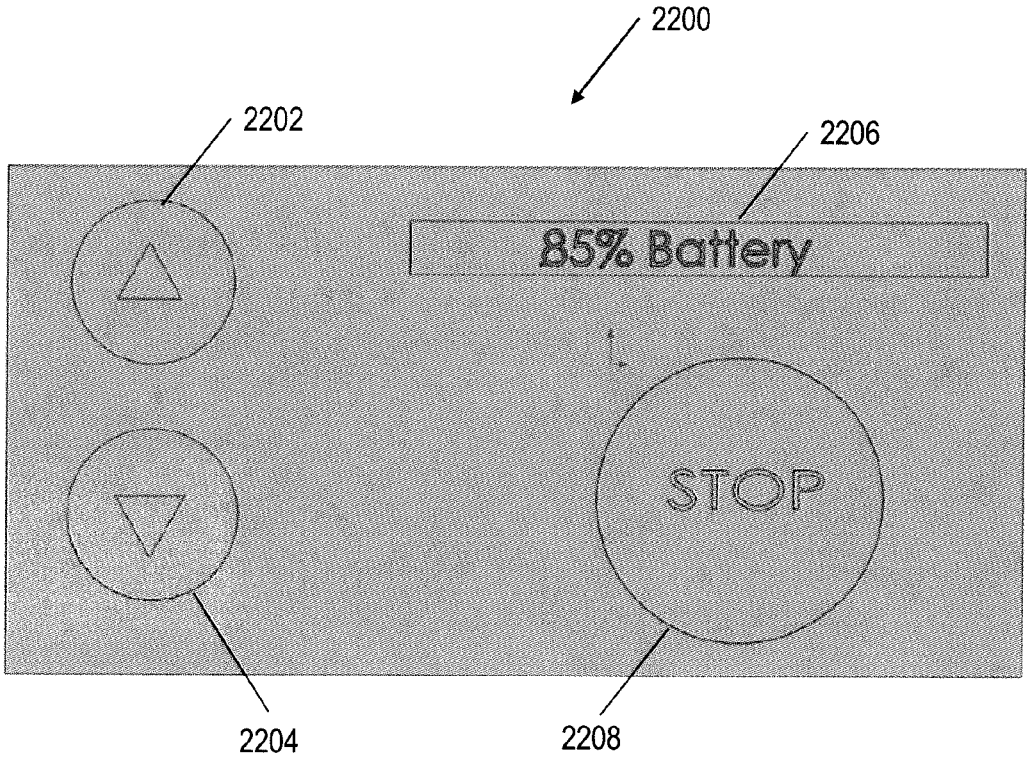
FIG. 23 is an exemplary user control panel included in user controls of the walker apparatus.

Referring next to FIG. 23, an exemplary user control panel 2200 included in the user controls 2110 is shown. Shown are an up control button 2202, a down control button 2204, a status indicator 2206, and the stop control button 2208.

The user control panel 2200 includes the up control button 2202, which when pressed by the user causes the walker 1200 to rise by simultaneously activating the double scissor mechanisms 1240, 1242 upwardly. Similarly, the down control button 2204 when pressed by the user causes the walker 1200 to lower by simultaneously activating the double scissor mechanisms 1240, 1242 downwardly. The control buttons 2202, 2204 may require a single press to start the activation, or the walker 1200 may only move when the control button 2202, 2204 is being continuously pressed.

The stop control button 2208 when pressed stops the movement of the double scissor mechanism 1240, 1242. The stop control button 2208 may also be used as a master reset button. In another embodiment pressing of the stop control button 2208 sends an alert to a device in communication with the walker 1200, for example a computing device at a nurse's station. In another embodiment, separate stop and emergency stop control buttons may be included in the user control panel, where the emergency stop button sends the alert in addition to stopping the movement of the walker 1200. The status indicator 2206 displays a current status of the walker 1200, including battery life remaining, as shown in FIG. 23. The status indicator 2206 may also display malfunction messages and/or other status messages such as the need for battery replacement. The user control panel 2200 may be hardwired to the main controller 2104 or may be wireless. The user control panel 2200 may be configured to connect to the network. The user control panel 2200 may be mechanically coupled to the walker 1200 or may be worn as a pendant or otherwise carried by the user.

Figure 24:
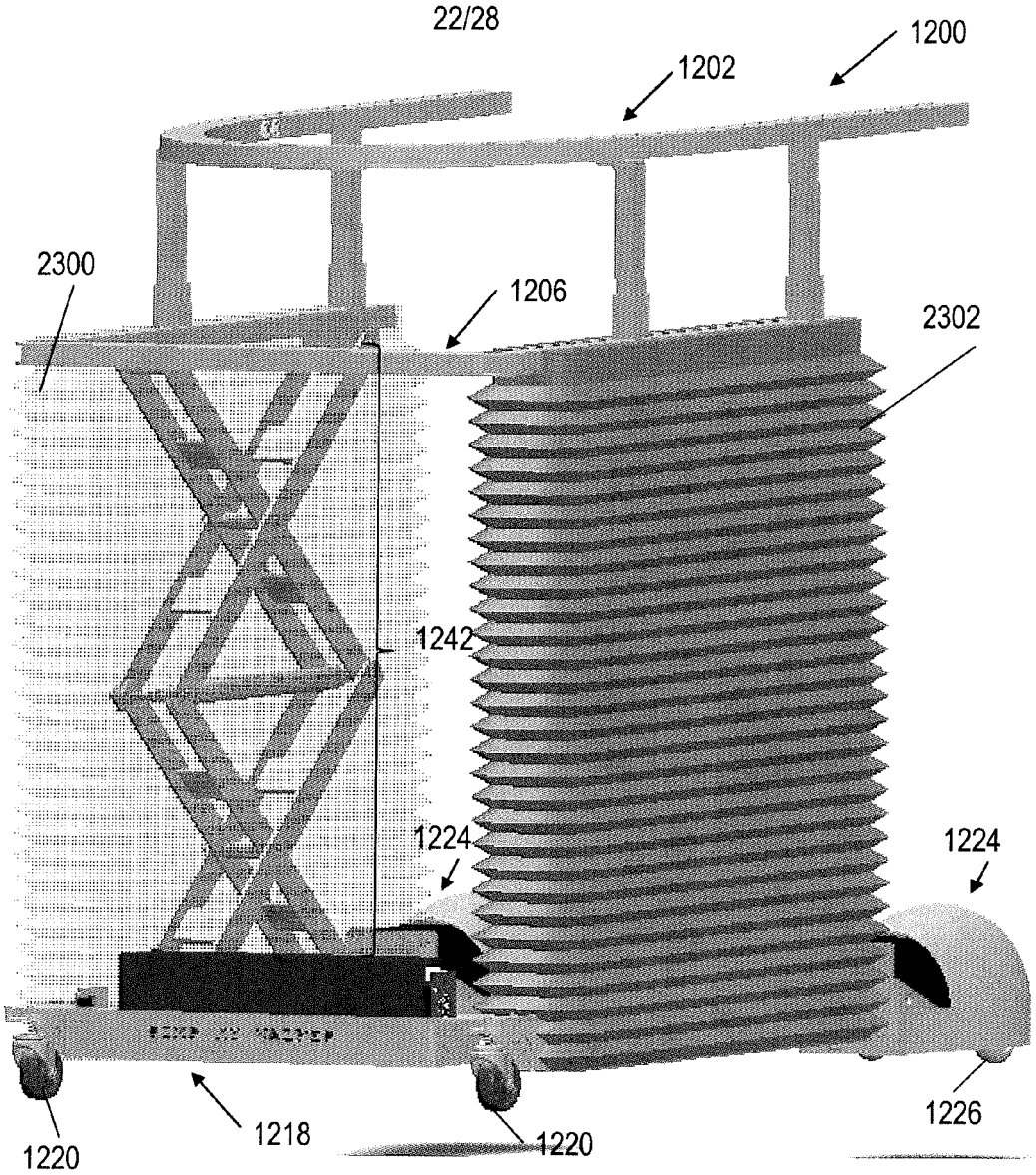
FIG. 24 is a perspective view of the walker apparatus double scissor mechanism covers in accordance with one embodiment of the present invention.

Referring next to FIG. 24, a perspective view of the walker 1200 with exemplary double scissor mechanism covers is shown. Shown are the walker 1200, the top horseshoe frame 1202, the upper frame 1206, the lower frame 1218, the plurality of casters 1220, the motor assemblies 1224, the plurality of rear wheels 1226, the left double scissor mechanism 1242, and a left double scissor mechanism cover 2300 and a right double scissor mechanism cover 2302.

The left double scissor mechanism cover 2300 is shown transparent to illustrate the relative location of the left double scissor mechanism 1242, but it will be understood that the covers 2300, 2302 may be transparent or opaque.

The left cover 2300 surrounds the left double scissor mechanism 1242, and the right cover 2302 surrounds the right double scissor mechanism 1240. Each cover 2300, 2302 includes vertical accordion folds to accommodate the raising and lowering of the walker 1200. The accordion folds are configured such that each cover 2300, 2302 spans the height of the fully raised double scissor mechanisms 1240, 1242, and each cover 2300, 2302 compresses down to the reduced folded double scissor height when the double scissor mechanisms 1240, 1242 are folded.

The covers 2300, 2302 protect the scissor mechanism components and protects the user from possible pinch points caused by the moving walker 1200 (e.g. scissor mechanism pivot points, the sliding block 1612, etc.). The covers 2300, 2302 also act as cushioning and protection from falls, especially if the covers 2300, 2302 are configured to be inflated with air.

Figure 25:
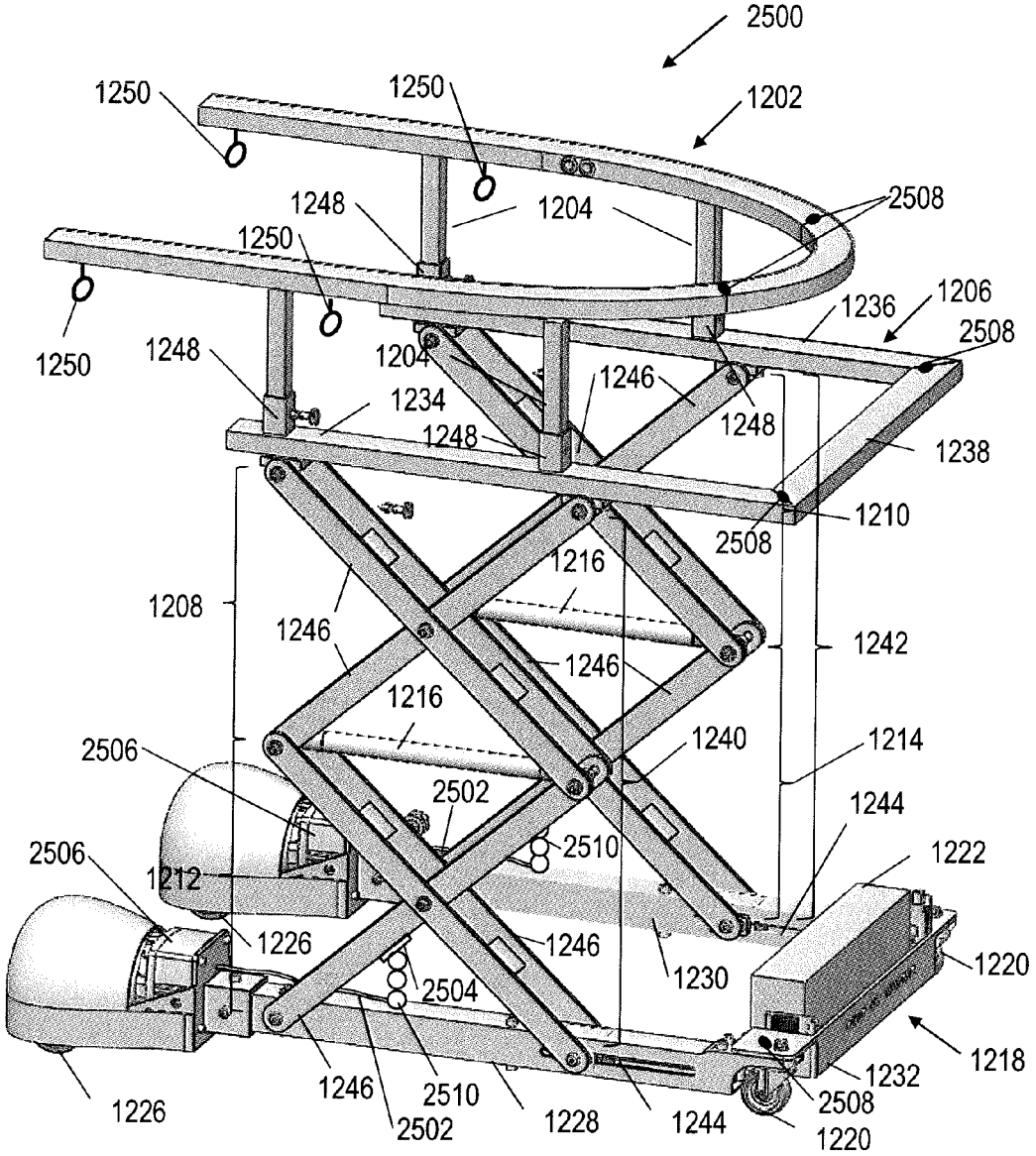
FIG. 25 is a perspective view of a walker apparatus in another embodiment of the present invention.

Referring next to FIG. 25, a perspective view of an adult walker apparatus 2500, in a fully raised position, in yet another embodiment of the invention is shown. Shown are the top horseshoe frame 1202, the plurality of vertical connectors 1204, the upper frame 1206, the top left scissor 1208, the top right scissor 1210, the bottom left scissor 1212, the bottom right scissor 1214, the plurality of gas springs 1216, the lower frame 1218, the plurality of front casters 1220, the battery pack 1222, the plurality of rear wheels 1226, the left lower arm 1228, the right lower arm 1230, the lower front connector 1232, the left upper arm 1234, the right upper arm 1236, the upper front connector 1238, the right double scissor mechanism 1240, the left double scissor mechanism 1242, the plurality of horizontal slots 1244, the plurality of scissor legs 1246, the plurality of sockets 1248, pneumatic tubing 2502, an actuator bearing plate 2504, a plurality of compressors 2506, and a plurality of hinges 2508, and a plurality of pneumatic actuator assemblies 2510.

In lieu of the motor assemblies 1224, the walker apparatus 2510 shown in FIG. 25 includes one compressor 2506 is coupled to the rear end of each lower arm 1228, 1230 (i.e. a right compressor 2506 and a left compressor 2506). Each compressor 2506 is coupled to and powered by the battery pack 1222. Each compressor 2506 is coupled to one pneumatic actuator assembly 2510 via the pneumatic tubing 2502, whereby the pneumatic actuator assemblies 2510 are actuated (operated) by the compressor 2506. Each compressor 2506 is also coupled to and controlled by the main controller 2014. In another embodiment compressed air storage tanks (a left compressed air storage tank coupled to the left lower arm 1228 and a right compressed air storage tank coupled to the right lower arm 1230) are used in lieu of the compressors 2506. The compressed air storage tanks would each include a mechanical regulator to adjust the air flow and determine the height of the walker 2600.

Each pneumatic actuator assembly 2510 is oriented for vertical movement and mounted to one lower arm 1228, 1230 between the connections of the lower scissor arms 1212, 1214, to the associated lower arm 1228, 1230. From the folded position, as the compressors 2506 actuate the pneumatic actuator assemblies 2510, a top end of the pneumatic actuator assemblies 2510 contacts one of the scissor legs 1246 and pushes the scissor leg 1246 upwards, thus raising the walker 2500. The pneumatic actuator assembly 2510 is also configured to contract, either via a dual-direction actuator or other mechanism such as a spring. The actuator bearing plate 2504 is coupled to a bearing location on each scissor leg 1246 and provides a bearing surface for each pneumatic actuator assembly 2510.

In lieu of the scissor lift assembly 1618 previously described, in the embodiment of FIG. 25 a sliding assembly is configured to fit within each lower arm 1228, 1230 and is slidably coupled to the horizontal slot 1244, so that the end of the scissor leg 1246 coupled to the sliding assembly slides along the horizontal slot 1244 as the double scissor mechanisms 1240, 1242 are raised and lowered.

Also included in the walker 2500 embodiment of FIG. 25 is the plurality of hinges 2508. One hinge 2508 is located at each intersection of the lower arms 1228, 1230 and the lower front connector 1232, and also at each intersection of the upper arms 1234, 1236 and the upper front connector 1238. Additionally two hinges 2508 are located on the top horseshoe frame 1202. The hinges 2508 are configured to allow the frames 1202, 1206, 1208 to open horizontally outward at the hinge 2508 locations, widening the rear opening of the walker 2500. The hinges 2508 are configured to lock in a closed position, an open position, and optionally intermediate positions.

In some embodiments the gas springs 1216 are changed to pneumatic actuators and assist in the raising and lowering of the double scissor mechanisms 1240, 1242.

In one embodiment each compressor 2506 is enclosed in a noise-reducing chamber.

Figure 26:
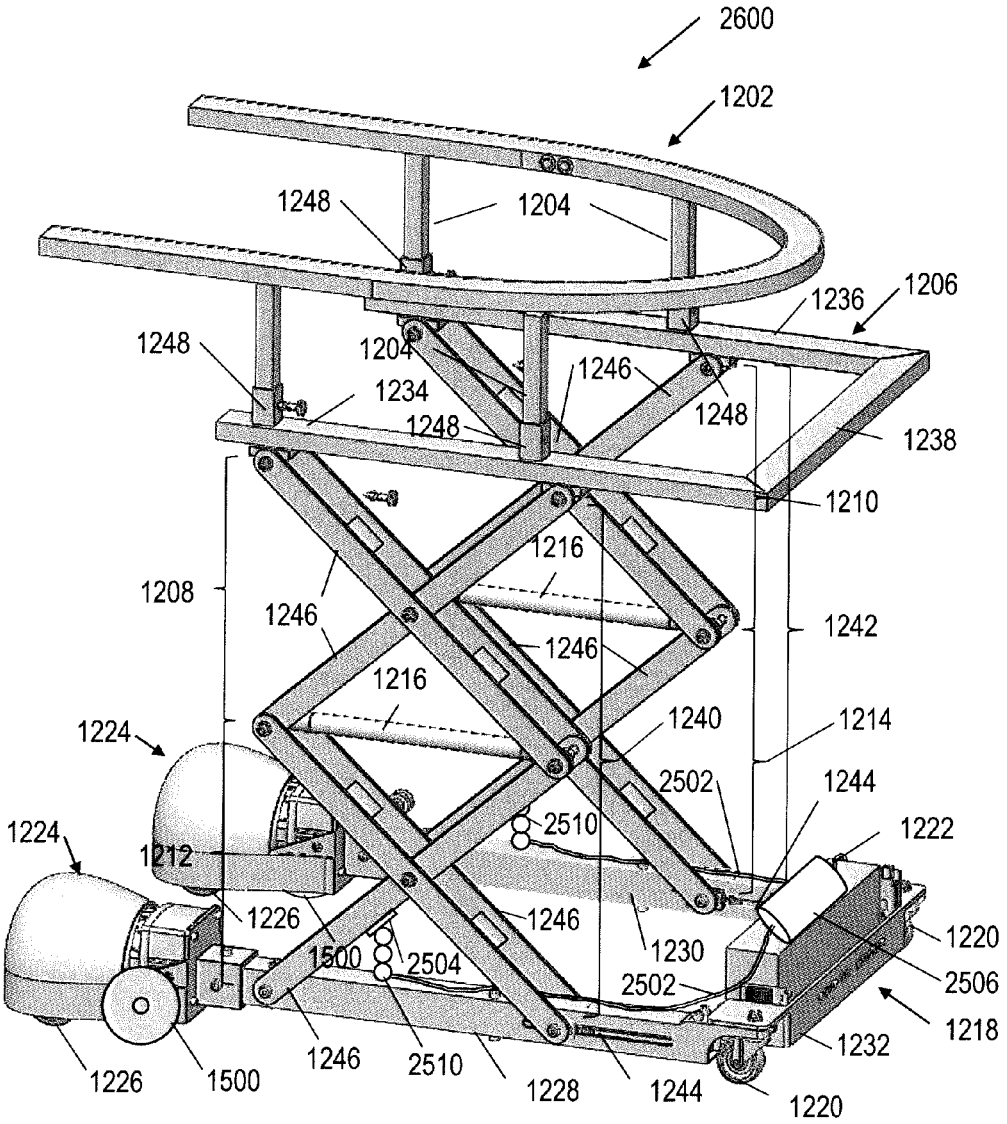
FIG. 26 is a perspective view of a walker apparatus in yet another embodiment of the present invention.

Referring next to FIG. 26, a perspective view of an adult walker apparatus 2600, in a fully raised position, in yet another embodiment of the invention is shown. Shown are the top horseshoe frame 1202, the plurality of vertical connectors 1204, the upper frame 1206, the top left scissor 1208, the top right scissor 1210, the bottom left scissor 1212, the bottom right scissor 1214, the plurality of gas springs 1216, the lower frame 1218, the plurality of front casters 1220, the battery pack 1222, the plurality of motor assemblies 1224, the plurality of rear wheels 1226, the left lower arm 1228, the right lower arm 1230, the lower front connector 1232, the left upper arm 1234, the right upper arm 1236, the upper front connector 1238, the right double scissor mechanism 1240, the left double scissor mechanism 1242, the plurality of horizontal slots 1244, the plurality of scissor legs 1246, the plurality of sockets 1248, the drive wheels 1500, the plurality of pneumatic actuator assemblies 2510, pneumatic tubing 2502, the actuator bearing plate 2504, the compressor 2506, and the plurality of hinges 2058.

In the embodiment of the walker 2600 shown in FIG. 26, the motor assemblies 1224 are included at the rear end of the lower frame 1218, as previously described. The motor assemblies 1224 are configured as for the drive wheel embodiment as shown previously in FIG. 19, providing for powered propulsion of the walker 2600. The pneumatic actuator assemblies 2510 are still coupled to the compressor 2506 via the pneumatic tubing 2504, but the compressor 2506 is mounted to the front portion of the lower frame 1218, either on top of the battery pack 1222 as shown or in another suitable location. This embodiment provides for powered motion of the walker 2600 while still using the pneumatic actuator assemblies 2510 for lowering and raising of the walker 2600.

Figure 27:
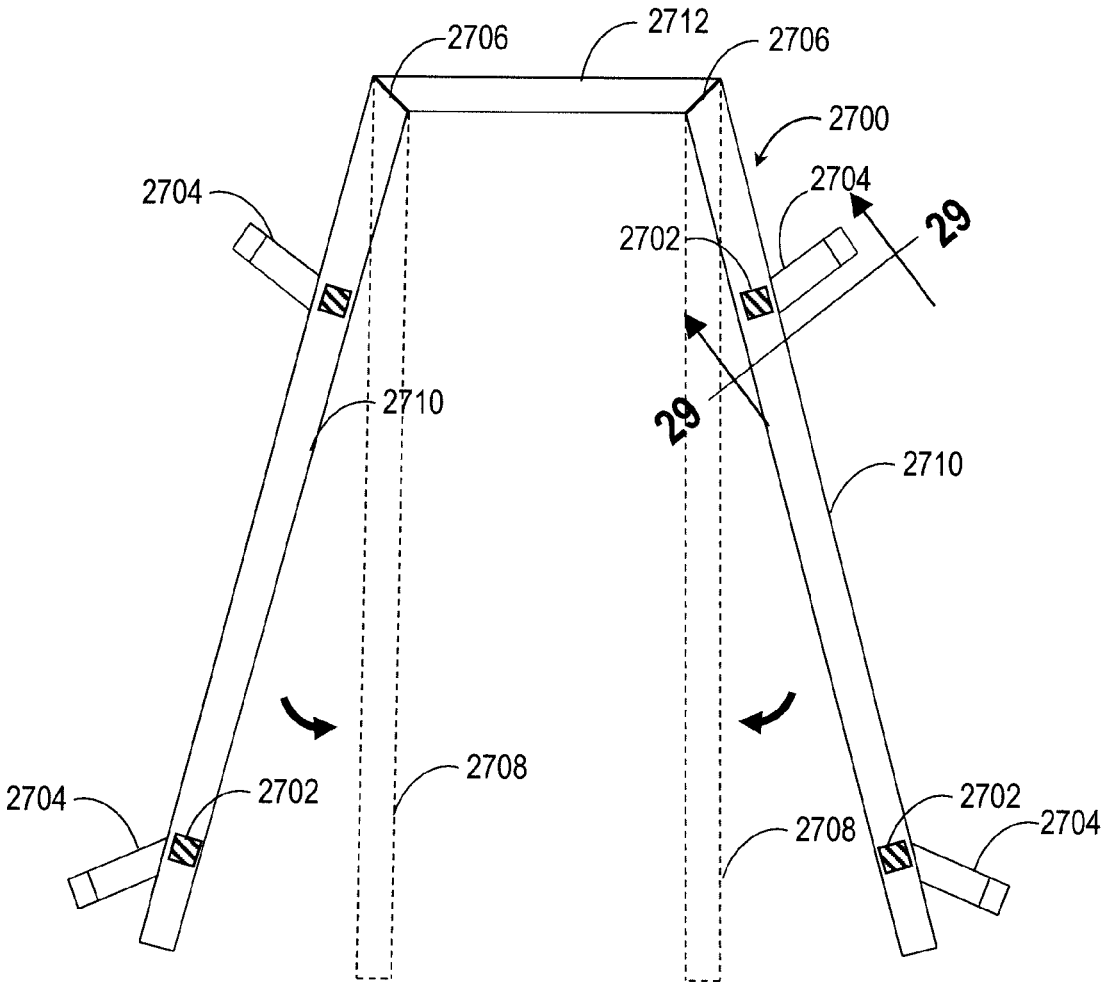
FIG. 27 is a plan view of a lower frame of a home walker in yet another embodiment of the present invention.

Referring next to FIG. 27, a plan view of a lower frame 2700 of a home walker is shown in yet another embodiment of the present invention. Shown are the lower frame 2700, a plurality of posts 2702, a plurality of tipping-prevention tabs 2704, a plurality of hinges 2706, and rotated leg positions 2708.

The home walker comprises a horizontally-oriented upper U-shaped frame 2800 (shown below in FIG. 28) above and parallel to the horizontally-oriented lower U-shaped frame 2700. The upper frame 2800 is coupled and structurally supported by the lower frame 2700 by the generally vertical posts 2702. The U-shape is formed by connecting two linear lower arms 2710 to a linear lower front connecting portion 2712. The lower frame 2700 includes the hinges 2706, which allow the legs 2710 of the lower frame 2700 to rotate inward from the angled position to the parallel rotated leg positions 2708. In one embodiment, the front connecting portion 2712 is about 12" long. Not shown are the plurality of casters coupled to an underside of the lower frame 2700.

Figure 28:
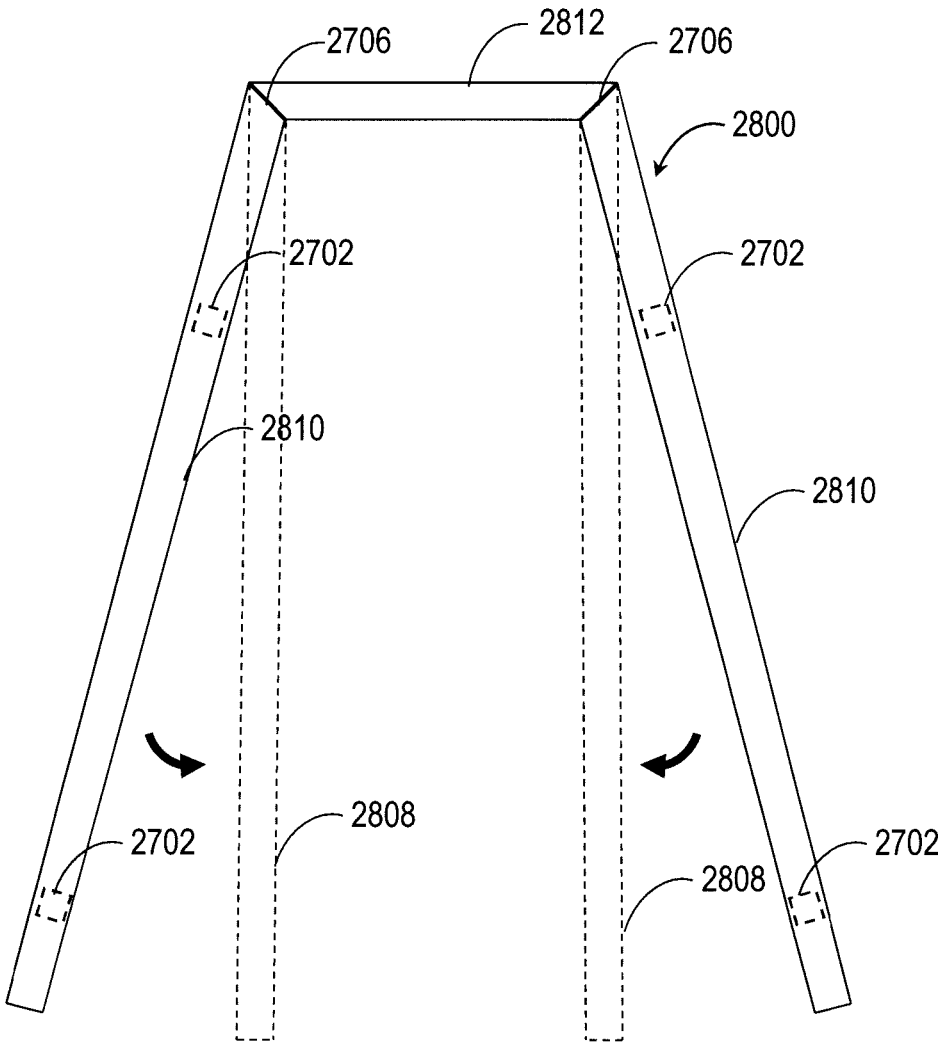
FIG. 28 is a plan view of an upper frame of the home walker.

Referring next to FIG. 28, an upper frame 2800 of the home walker is shown. Shown are the upper frame 2800, a plurality of posts 2702, a plurality of tipping-prevention tabs 2704, a plurality of hinges 2706, rotated upper leg positions 2808, upper legs 2810 and upper front connection portion 2812.

The upper frame 2800 is of similar configuration to the lower frame 2700, with the exception that the upper frame does not include the tipping-prevention tabs 2704.

In operation, the upper frame legs 2810 and the lower frame legs 2710 are rotated simultaneously using the hinges 2706, allowing the home walker to be opened wider in the rear.

Figure 29:
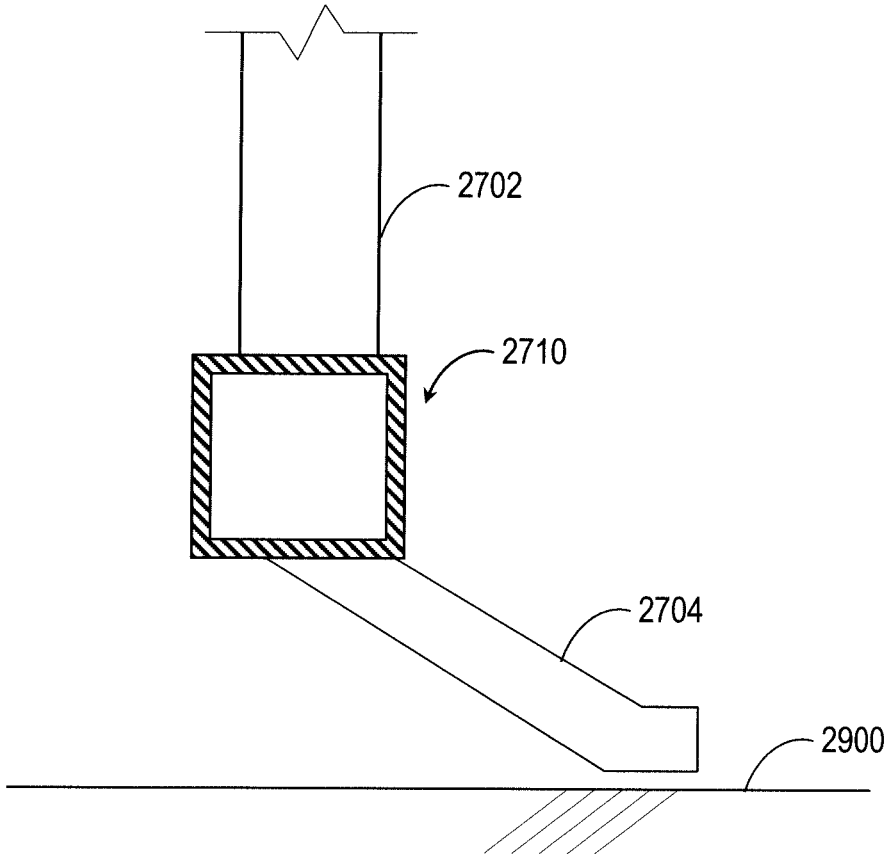
FIG. 29 is an elevational view of a fall prevention tab of the home walker.

Referring next to FIG. 29, an elevational view of one tipping-prevention tab 2704 is shown. Shown are the post 2702, the lower frame leg 2710, the tipping-prevention tab 2704, and a ground surface 2900. For clarity, casters supporting the home walker on the ground are not shown.

The tipping-prevention tab 2704 is coupled to the lower frame leg 2710 and extends diagonally outward and downward from the lower leg 2710. The tipping-prevention tab 2704 terminates at a small distance from the ground surface 2900, in one example clearing the ground surface 2900 by about ½". A lower end portion of the tipping-prevention tab 2704 may be parallel to the ground surface 2900.

The tipping-prevention tabs 2704 allow the home walker to roll on the casters, while preventing tipping of the home walker. If the home walker starts to tip to one side, the tipping-prevention tabs 2704 contact the ground surface 2900, preventing further rotation of the home walker and preventing the home walker from tipping over.

Figure 30:
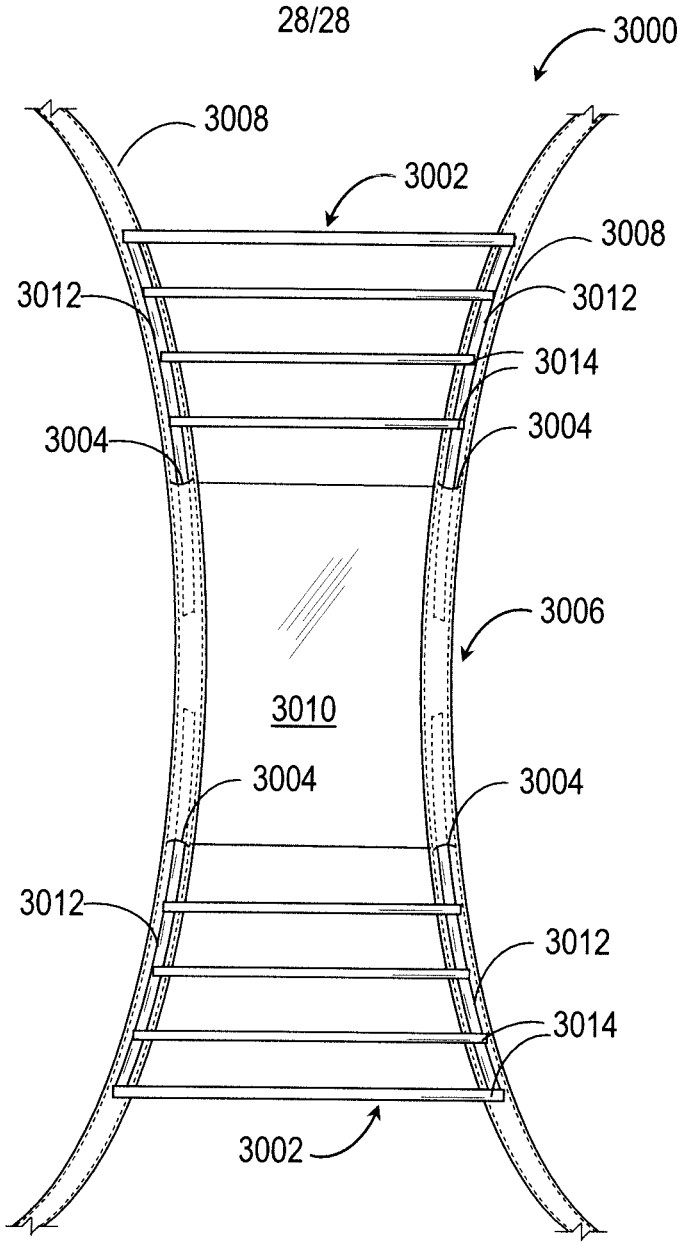
FIG. 30 is a plan view of a harness apparatus in another embodiment of the present invention.

Referring next to FIG. 30, a harness apparatus 3000 is shown in another embodiment of the present invention. Shown are a plurality of support frames 3002, a plurality of insertion points 3004, a harness 3006, two harness straps 3008, a harness seat 3010, a plurality of rails 3012, and a plurality of rungs 3014.

The harness 3006 comprises the two harness straps 3008 coupled together at a central portion by the harness seat 3010, similar to the embodiment described in FIG. 9. Harness strap ends are configured to attach to the walker (not shown). The harness straps 3008 are at least partially tubular, although if the harness straps 3008 comprise a flexible material the straps 3008 may generally appear flat. Each harness strap 3008 includes two insertion points 3004, with each insertion point 3004 generally located at an outer end of the harness seat 3010, for a total of four insertion points 3004 (two per harness strap 3008).

The harness apparatus 3000 includes two support frames 3002, each in a ladder-like configuration with two "rails" 3012 and the plurality of "rungs" 3014 connecting the two rails 3012. One end of the support frame 3002 is configured for each rail end to slide into one insertion point 3004 and within the harness strap 3008, coupling each support frame 3002 to one end of the harness 3006. The rails 3012 then also rest on and are supported by the harness straps 3008. The addition of the support frames 3002 provide additional security and fall prevention for the user of the harness 3000, and are removable if not required.

Software comprising executable code may, for instance, comprise one or more physical or logical blocks of computer instructions that may, for instance, be organized as an object, procedure, or function. The executables of an identified module of software need not be physically located together, but may comprise disparate instructions stored in different locations which, when joined logically together, comprise the module and achieve the stated purpose for the software code.

Indeed, a module of executable code (software) could be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

While the invention herein disclosed has been described by means of specific embodiments, examples and applications thereof, numerous modifications and variations could be made thereto by those skilled in the art without departing from the scope of the invention set forth in the claims.

What is claimed is:

1. A walker apparatus comprising:

a U-shaped lower frame comprising a left lower arm and a right lower arm connected by a front lower connector, the lower frame oriented in a horizontal position;

at least two swivel casters coupled to an underside of a front portion of the lower frame;

at least four rear wheels, wherein at least two rear wheels are coupled to a rear portion of the left lower arm and at least two wheels are coupled to a rear portion of the right lower arm, wherein the casters and the rear wheels support and the lower frame on a floor and allowing the walker apparatus to roll across the floor;

a U-shaped upper frame comprising a left upper arm and a right upper arm connected by a front upper connector, the upper frame oriented in a horizontal position generally above the lower frame, whereby the left upper arm is generally above the left lower arm and the right upper arm is generally above the right lower arm, and wherein the lower frame and upper frame are configured to surround a person on three sides;

a generally vertical left double scissor mechanism interposed between the left lower arm and the left upper arm;

a generally vertical right double scissor mechanism interposed between the right lower arm and the right upper arm, each double scissor mechanism comprising a top X-shaped scissor pivotally coupled to a bottom X-shaped scissor, wherein a vertical distance between the upper frame and the lower frame can be varied by simultaneously adjusting the left double scissor mechanism and the right double scissor mechanism.

2. The walker apparatus of claim 1 configured such that a user of the walker apparatus enters the walker apparatus from an open rear side of the walker apparatus, whereby the user is surrounded on the front, left and right sides.

3. The walker apparatus of claim 2 wherein the rear side of the walker apparatus remains open during operation of the walker apparatus by the user.

4. The walker apparatus of claim 1 further comprising a left compressor coupled to the left lower arm and a right compressor coupled to the right lower arm, each compressor electrically coupled to a battery pack, whereby the left compressor is configured to adjust the left double scissor mechanism and the right compressor is configured to adjust the right double scissor mechanism.

5. The walker apparatus of claim 4 further comprising a user control communicatively coupled to the compressors and configured to receive user input and send signals to the left compressor and the right compressor, whereby the left compressor and the right compressor are controlled.

6. The walker apparatus of claim 5 wherein the user control is configured to receive a stop input from a user, whereby movement of the double scissor mechanisms is stopped.

7. The walker apparatus of claim 6 wherein the user control is connected to a network, wherein the stop input is an emergency stop input, and wherein receiving of the emergency stop input includes sending by the user control of an alert via the network.

8. The walker apparatus of claim 5, wherein in response to user input, the walker apparatus is adjusted to a pre-set height.

9. The walker apparatus of claim 4, further comprising a main controller comprising a processor, non-transitory memory coupled to the processor, software stored on the processor and configured to run on the processor, the main controller coupled to the left compressor and the right compressor and the battery pack, and communicatively coupled to and configured to control the left compressor and the right compressor.

10. The walker apparatus of claim 4, further comprising:

a left pneumatic actuator assembly powered by the left compressor and operable to raise and lower the left double scissor mechanism; and a right pneumatic actuator assembly powered by the right compressor and operable to raise and lower the right double scissor mechanism.

11. The walker apparatus of claim 1, wherein each X-shaped scissor comprises two scissor legs pivotally coupled at a center pivot point.

12. The walker apparatus of claim 11, wherein each scissor leg comprises two parallel bars coupled by intermediate stitch plates.

13. The walker apparatus of claim 1, further comprising two horizontal gas springs, each gas spring spanning the pivotal coupling between each top X-shaped scissor and the corresponding bottom X-shaped scissor, wherein each gas spring provides a contracting force at the pivotal coupling, whereby raising of the walker apparatus is aided.

14. The walker apparatus of claim 1, further comprising a top horseshoe frame comprising a horseshoe shape and located above the upper frame, wherein the top horseshoe frame is removably coupled to the upper frame.

15. The walker apparatus of claim 14, wherein the top horseshoe frame is generally above an iliac crest of a user of the walker apparatus.

16. The walker apparatus of claim 14, the top horseshoe frame further comprising attachment points.

17. The walker apparatus of claim 1, wherein a folded height of the walker apparatus is less than 12 inches.

18. The walker apparatus of claim 1, wherein a center of gravity of the walker apparatus prevents tipping of the walker apparatus when used by a user.

19. The walker apparatus of claim 1, wherein the casters are located at intersections of the lower arms and a lower front connector connecting the lower arms whereby a tipping moment resistance of the walker apparatus is increased.

20. The walker apparatus of claim 1, wherein the rear wheels are coupled to the lower frame proximate to a rear end of the lower frame, whereby a tipping moment resistance of the walker apparatus is increased.

21. The walker apparatus of claim 20, wherein the rear wheels are non-swiveling.

22. The walker apparatus of claim 1, wherein the lower frame clears the floor by a maximum of approximately ½", whereby tipping of the walker apparatus is prevented.

23. The walker apparatus of claim 1 further comprising a left compressed air storage tank coupled to the left lower arm and a right compressed air storage tank coupled to the right lower arm, whereby the left compressed air storage tank is configured to adjust the left double scissor mechanism and the right compressed air storage tank is configured to adjust the right double scissor mechanism.

* * * * *